US006543316B2

(12) United States Patent
Daigle et al.

(10) Patent No.: US 6,543,316 B2
(45) Date of Patent: Apr. 8, 2003

(54) RATCHET WRENCH

(75) Inventors: Odee P. Daigle, Garland, TX (US); Nick Savino, Irving, TX (US); David Loftin, Burelson, TX (US); Glenn Redding, Flower Mound, TX (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/805,434

(22) Filed: Mar. 14, 2001

(65) Prior Publication Data

US 2002/0005093 A1 Jan. 17, 2002

Related U.S. Application Data

(60) Provisional application No. 60/267,694, filed on Feb. 12, 2001, and provisional application No. 60/189,054, filed on Mar. 14, 2000.

(51) Int. Cl.[7] ..... B25B 13/46
(52) U.S. Cl. ..... 81/63; 81/63.2
(58) Field of Search ..... 81/63, 63.2

(56) References Cited

U.S. PATENT DOCUMENTS

| | | | |
|---|---|---|---|
| 2,943,523 | A | 7/1960 | Gray et al. |
| 2,978,081 | A | 4/1961 | Lundin |
| 3,019,682 | A | 2/1962 | Hare |
| 3,265,171 | A | 8/1966 | Kilness |
| 3,299,725 | A | 1/1967 | Gewirc et al. |
| 3,369,416 | A | 2/1968 | Kilness |
| 3,436,992 | A | 4/1969 | Over et al. |
| 3,467,231 | A | 9/1969 | Haznar |
| 4,053,037 | A | 10/1977 | Solomon |
| 4,147,076 | A | 4/1979 | Wright et al. |
| 4,308,769 | A | 1/1982 | Rantanen |
| 4,328,720 | A | 5/1982 | Shiel |
| 4,420,995 | A | 12/1983 | Roberts |
| 4,485,700 | A | 12/1984 | Colvin |
| 4,497,227 | A | 2/1985 | Stasiek |
| 4,507,990 | A | 4/1985 | Lack |
| 4,631,988 | A | 12/1986 | Colvin |
| 4,762,033 | A | 8/1988 | Chow |
| 4,817,476 | A | 4/1989 | Karge |
| 4,903,554 | A | 2/1990 | Colvin |
| 4,907,476 | A | 3/1990 | Singleton |
| 4,991,470 | A | 2/1991 | Singleton |

(List continued on next page.)

FOREIGN PATENT DOCUMENTS

| | | | | |
|---|---|---|---|---|
| DE | 298 08 840 | | 9/1998 | |
| FR | 1 538 615 A | | 9/1968 | |
| FR | 1538615 A | * | 9/1968 | ..... B25B/13/46 |
| NO | 93743 | | 4/1959 | |
| NO | 87890 | | 9/1959 | |

*Primary Examiner*—Joseph J. Hail, III
*Assistant Examiner*—David B. Thomas
(74) *Attorney, Agent, or Firm*—Pillsbury Winthrop LLP

(57) ABSTRACT

A ratchet wrench includes a wrench body and a switch member that is operatively coupled to a gear engaging member so as to be accessible from an exterior of the wrench body. A spring applies a biasing force to the gear engaging member such that the gear engaging member having one or more engaging teeth engages with gear teeth of a torque receiving gear in intermeshed relation. A mounting element mounts the gear engaging member to the switch element. The gear engaging member is pivotally mounted to the mounting element. The pivotal mounting of the gear engaging member enables the gear engaging member to pivot relative to the mounting element as the gear engaging member moves between a first ratcheting position and a second ratcheting position thereof. Also provided is switch securing structure for securing the switch during operation of the ratchet wrench and a method of making the ratchet wrench.

13 Claims, 17 Drawing Sheets

U.S. PATENT DOCUMENTS 5,157,994 A 10/1992 Krivec
5,178,047 A 1/1993 Arnold et al.
5,199,330 A 4/1993 Arnold et al.
5,207,129 A 5/1993 Fossella
5,230,262 A 7/1993 Ahlund et al.
5,231,903 A 8/1993 Bockman, Jr.
5,386,747 A * 2/1995 Grover ..... 81/63
5,448,931 A 9/1995 Fossella et al.
5,499,560 A 3/1996 Aeschliman
5,533,427 A 7/1996 Chow
5,557,994 A 9/1996 Nakayama
5,626,062 A 5/1997 Colvin
5,794,496 A 8/1998 Arnold
5,857,390 A 1/1999 Whiteford
5,913,954 A 6/1999 Arnold et al.
5,927,158 A 7/1999 Lin
5,941,141 A 8/1999 Whitley
5,946,987 A 9/1999 Wei
5,953,966 A 9/1999 Spirer
5,957,008 A 9/1999 Long
5,957,009 A * 9/1999 McCann ..... 81/63.2
6,044,730 A 4/2000 Roberts et al.
6,109,141 A 8/2000 Nurmi
6,161,454 A 12/2000 Chaconas
6,164,166 A 12/2000 Whiteford
6,205,890 B1 3/2001 Roberts et al.
6,257,097 B1 * 7/2001 I-He ..... 81/63
6,260,449 B1 * 7/2001 I-He ..... 81/63.2
6,263,768 B1 * 7/2001 Huang et al. ..... 81/63
6,282,991 B1 * 9/2001 Hu ..... 81/63.2
6,282,992 B1 * 9/2001 Hu ..... 81/63.2
6,282,993 B1 * 9/2001 Forman et al. ..... 81/63.2

* cited by examiner

RATCHET WRENCH

The present application claims priority to U.S. Provisional Application No. 60/189,054 of Daigle filed Mar. 14, 2000, and U.S. Provisional Appln. No. 60/267,694 of Savino, filed Feb. 12, 2001, the entirety of each of which are hereby incorporated into the present application by reference.

FIELD OF THE INVENTION

The present invention relates to a ratchet wrench for selectively applying torque to fasteners.

BACKGROUND OF THE INVENTION

Many types of ratchet wrenches are known in the art. Conventional wrenches typically include a wrench body, a torque receiving gear having gear teeth, a switch member and a gear engaging member in the form of a pawl having engaging teeth for intermeshing with the teeth on the torque receiving gear. Typically, the switch member in a conventional ratchet wrench is selectively movable between two positions. In each of these two position, the pawl is engaged with the gear teeth such that the wrench in one direction rotates the gear to apply torque to a fastener and rotating the wrench in the opposite direction causes the pawl to ride over the gear teeth in a ratcheting manner.

U.S. Pat. No. 5,533,427 discloses a ratchet wrench with an arcuate pawl. The arcuate shape of the pawl enables most or all of the teeth to be engaged with the gear teeth. The pawl is pivotally mounted on the upright free end of a torsion spring. The spring biases the pawl into engagement with the gear so as to provide a ratcheting action on the wrench's return stroke. As the switch is moved between positions, the upright free end of the torsion spring swings and moves the pawl to its opposite position for reverse driving. One drawback of this design, however, is that if the pawl is slightly stuck or jammed, movement of the switch may simply deflect the spring without moving the pawl.

Another shortcoming of this type of wrench is that the switch member is not sufficiently secured in either switch position during ratcheting. For example, in the '427 patent, a ball and spring are retained in a bore that is formed within the wrench body and the switch member has two detents formed therein. The spring biases the ball into a respective one of these detents in the switch member to retain the switch member in its associated switching position, and hence retains the pawl in its associated reversing position. However, in this configuration, the switch may having a tendency to move from one switch position to the other switch position during ratcheting, especially if accidentally bumped in that direction. As a result, during use of the wrench, users may have to hold the switch, for example, with their thumb or finger, tape or some other securing means, or ratchet the wrench slower to prevent undesired switch movement. The undesired switch movement can lead to a more difficult and more time-consuming ratcheting operation.

SUMMARY OF THE INVENTION

To address the problems realized with prior art wrenches, one aspect of the present invention provides a ratchet wrench for selectively applying torque to fasteners. The ratchet wrench comprises a wrench body providing (a) an elongated manually engageable handle configured for manual grasping thereof and (b) a ratchet head provided on the handle. The wrench body further provides spaced apart first and second engaging member abutment surfaces.

A torque receiving gear is mounted for rotation about a gear axis relative to the ratchet head with the torque receiving gear providing a plurality of gear teeth provided about the gear axis in a circular arrangement. The torque receiving gear is constructed and arranged to be removably coupled to a rotatable fastener in torque transmitting relation such that torque applied to the torque receiving gear is transmitted to the fastener removably coupled therewith to affect rotation of the fastener.

A switch member is accessible from an exterior of the wrench body. The switch member is selectively movable between a first switch position and a second switch position. A gear engaging member has a set of engaging teeth provided in an arcuate and concave arrangement substantially complementary to the circular arrangement of the gear teeth. The engaging teeth are configured to be engaged with the gear teeth in intermeshed relation.

A mounting element mounts the gear engaging member to the switch element. The gear engaging member is pivotally mounted to the mounting element such that selective movement of the switch member into the first position thereof moves the gear engaging member into a first ratcheting position and selective movement of the switch member into the second position thereof moves the gear engaging member into a second ratcheting position angularly spaced from the first ratcheting position with respect to the gear axis. The pivotal mounting of the gear engaging member enables the gear engaging member to pivot relative to the mounting element as the gear engaging member moves between the first and second ratcheting positions thereof.

The gear engaging member is constructed and arranged such that, when the torque receiving gear is removably coupled to a rotatable fastener in torque transmitting relation as aforesaid and the gear engaging member is in the first ratcheting position thereof, a force applied to the handle to affect a first torque applying movement abuts the gear engaging member against the first abutment surface. This forceably engages the engaging teeth of the gear engaging member with the gear teeth of the torque receiving gear in intermeshed relation to prevent rotation of the wrench body relative to the torque receiving gear so that the force applied to the handle to affect the first torque applying movement is transmitted through the gear engaging member and applied to the gear as a torque which is transmitted to the fastener to affect rotation thereof via the torque transmitting relation between the gear and the fastener. The gear engaging member also is constructed and arranged such that, when the torque receiving gear is removably coupled to a rotatable fastener in torque transmitting relation as aforesaid and the gear engaging member is in the second ratcheting position thereof, a force applied to the handle to affect a second torque applying movement abuts the gear engaging member against the second abutment surface. This forceably engages the engaging teeth of the gear engaging member with the gear teeth of the torque receiving gear to prevent rotation of the wrench body relative to the torque receiving gear so that the force applied to the handle to affect the second torque applying movement is transmitted through the gear engaging member and applied to the gear as a torque which is transmitted to the fastener to affect rotation thereof via the torque transmitting relation between the ratchet gear and the fastener.

A spring is engaged between the switch member and the mounting element to apply a biasing force to the gear engaging member through the mounting element. The spring and the mounting element are constructed and arranged such that, (a) when the gear engaging member is in the first ratcheting position, the spring is disposed in a first spring biasing position so that at least a component of the biasing force is directed circumferentially with respect to the gear axis and (b) when the gear engaging member is in the second ratcheting position, the spring is disposed in a second spring biasing position so that at least a component of the biasing force is directed circumferentially with respect to the gear axis.

The gear engaging member and the spring are constructed and arranged such that, when the torque receiving gear is removably coupled to a rotatable fastener in torque transmitting relation as aforesaid and the gear engaging member is in the first ratcheting position thereof, a force applied to the handle to affect a movement opposite the first torque applying movement rotates the wrench body relative to the torque receiving gear so that (a) the first abutment surface moves to a position wherein it allows the gear engaging member to move radially outward with respect to the rotational axis to permit the engaging teeth to disengage from the gear teeth, and (b) the engaging member moves generally circumferentially with respect to the gear axis with the engaging teeth thereof repeatedly interacting with the gear teeth in a ratcheting manner wherein repeated engagement of the engaging teeth with the gear teeth repeatedly stresses the spring to a stress sufficient to cause the engaging teeth to interact with the gear teeth so as to move the gear engaging member generally radially out of engagement with the gear teeth and generally circumferentially relative to the gear along with the wrench body.

The gear engaging member and the spring are constructed and arranged such that, when the torque receiving gear is removably coupled to a rotatable fastener in torque transmitting relation as aforesaid and the gear engaging member is in the second ratcheting position thereof, a force applied to the handle to affect a movement opposite the second torque applying movement rotates the wrench body relative to the torque receiving gear so that (a) the second abutment surface moves to a position wherein it allows the gear engaging member to move radially outward with respect to the rotational axis to permit the engaging teeth to disengage from the gear teeth, and (b) the engaging member moves generally circumferentially with respect to the gear axis with the engaging teeth thereof repeatedly interacting with the gear teeth in a ratcheting manner wherein repeated engagement of the engaging teeth with the gear teeth repeatedly stresses the spring to a stress sufficient to cause the engaging teeth to interact with the gear teeth so as to move the gear engaging member generally radially out of engagement with the gear teeth and generally circumferentially relative to the gear along with the wrench body.

Another aspect of the invention provides a ratchet wrench for selectively applying torque to fasteners. The ratchet wrench comprises a wrench body providing (a) an elongated manually engageable handle configured for manual grasping thereof and (b) a ratchet head provided on the handle. The wrench body further provides spaced apart first and second securing member receiving portions.

A torque receiving gear is mounted for rotation about a gear axis relative to the ratchet head. The torque receiving gear is constructed and arranged to be removably coupled to a rotatable fastener in torque transmitting relation such that torque applied to the torque receiving gear is transmitted to the fastener removably coupled therewith to affect rotation of the fastener. The torque receiving gear has a plurality of gear teeth.

A gear engaging member having one or more engaging teeth is configured to be engaged with the gear teeth in intermeshed relation. The gear engaging member is movable between (A) a first ratcheting position wherein the one or more engaging teeth engage the gear teeth in the intermeshed relation such that (1) force applied to the handle in a first torque applying direction is transmitted through the gear engaging member and applied as torque about the gear axis to the torque receiving gear, and (2) force applied to the handle in a second torque applying direction moves the wrench body relative to the gear with the one or more engaging teeth ratcheting over the gear teeth, and (B) a second ratcheting position wherein the engaging teeth engage the gear teeth in the one or more intermeshed relation such that (1) force applied to the handle in the second torque applying direction is transmitted through the gear engaging member and applied as torque to the torque receiving gear, and (2) force applied to the handle in the first torque applying direction moves the wrench body relative to the gear with the one or more engaging teeth ratcheting over the gear teeth.

A switch member is accessible from an exterior of the wrench body and is operatively coupled to the gear engaging member. The switch member is selectively movable between a first switch position to move the gear engaging member to the first ratcheting position thereof and a second switch position to move the gear engaging member to the second ratcheting position thereof.

The switch member has a securing member cooperable with each of the first and second securing member receiving portions such that (a) movement of the switch member into the first position thereof moves the securing member into engagement with the first securing member receiving portion to releasably retain the switch member in the first switch position thereof and the gear engaging member in the first ratcheting position thereof and (b) selective movement of the switch member into the second position thereof moves the securing member into engagement with the second securing member receiving portion to releasably retain the switch member in the second switch position thereof and the gear engaging member in the second ratcheting position thereof.

Other objects, features and advantages of the present invention will become apparent from the following detailed description, the accompanying drawings, and the appended claims.

DETAILED DESCRIPTION OF THE PRESENT INVENTION

FIGS. 1–8 illustrate a ratchet wrench, generally indicated at 10, for selectively applying torque to fasteners. The ratchet wrench 10 comprises a metal wrench body, generally indicated at 12, a torque receiving gear, generally indicated at 14, a switch member, generally indicated at 16, a gear engaging member, generally indicated at 18 and a plunger assembly or securing assembly, generally indicated at 20.

The wrench body 12 provides an elongated manually engageable handle 22 configured for manual grasping thereof and a ratchet head 24 provided on the handle 22. In the illustrated embodiment, the handle 22 and the head 24 are integrally formed together. However, the invention is not limited to such an arrangement and may cover two-piece constructions wherein the head is movable relative to the handle.

Figure 7:
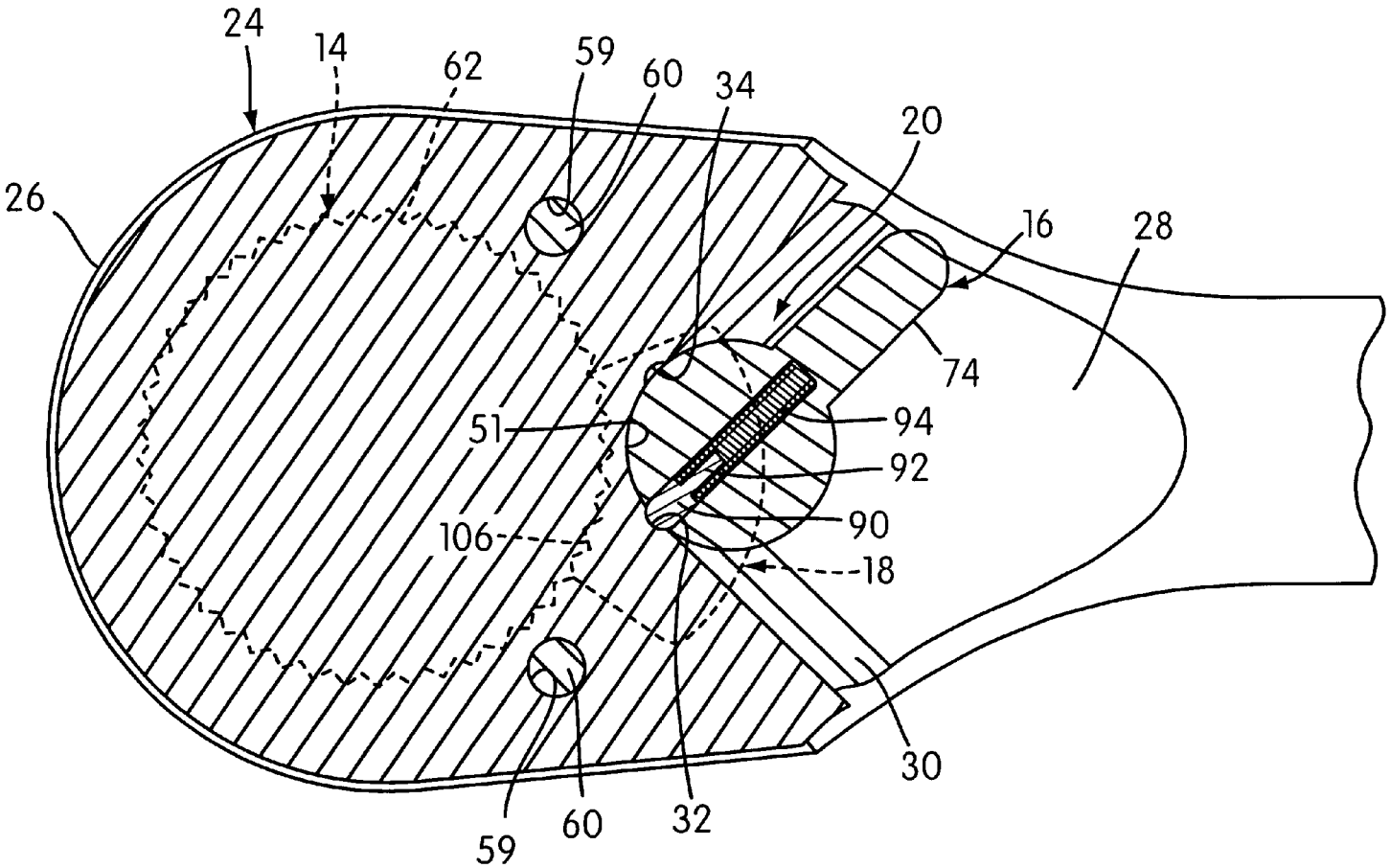
FIG. 7 is a cross sectional view taken along the line 7—7 of FIG. 6 showing the switch member in a first switch position thereof.
Figure 8:
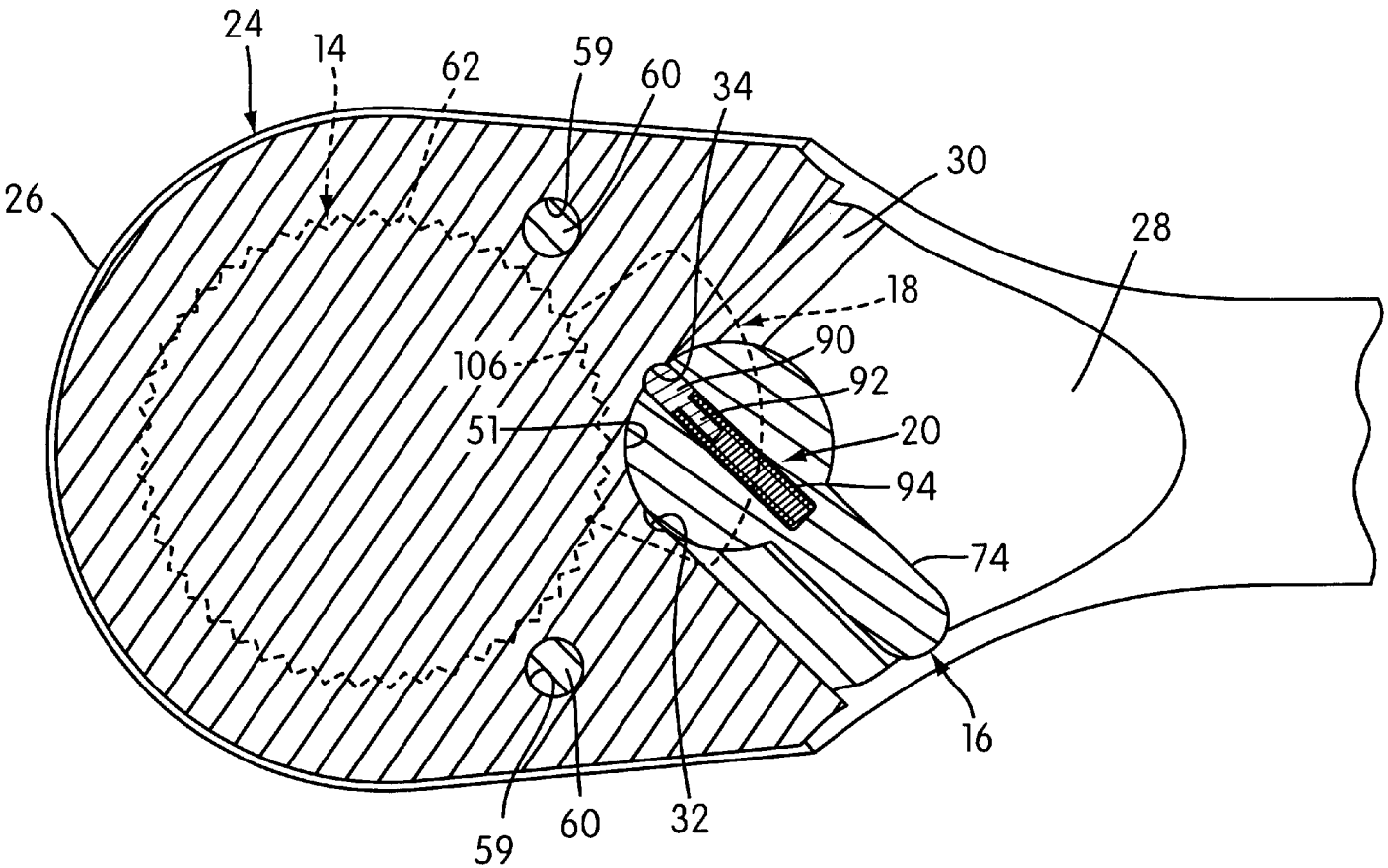
FIG. 8 is a cross sectional view similar to FIG. 7, but showing the switch member in a second switch position thereof.

In the illustrated embodiment, the ratchet head 24 provides a front portion 26 and a rear portion 28. At a transition between the front portion 26 and the rear portion 28, a transitional wall 30 is integrally disposed between the front portion 26 and the rear portion 28 to position the front and rear portions 26, 28 at different heights with respect to one another. For example, in FIG. 1, the front portion 26 is positioned at an elevated height with respect to the rear portion 28. A pair of spaced apart first and second plunger receiving cavities 32, 34 (also referred to as detents) are formed in the transitional wall 30, as best seen in FIGS. 7 and 8.

Figure 2:
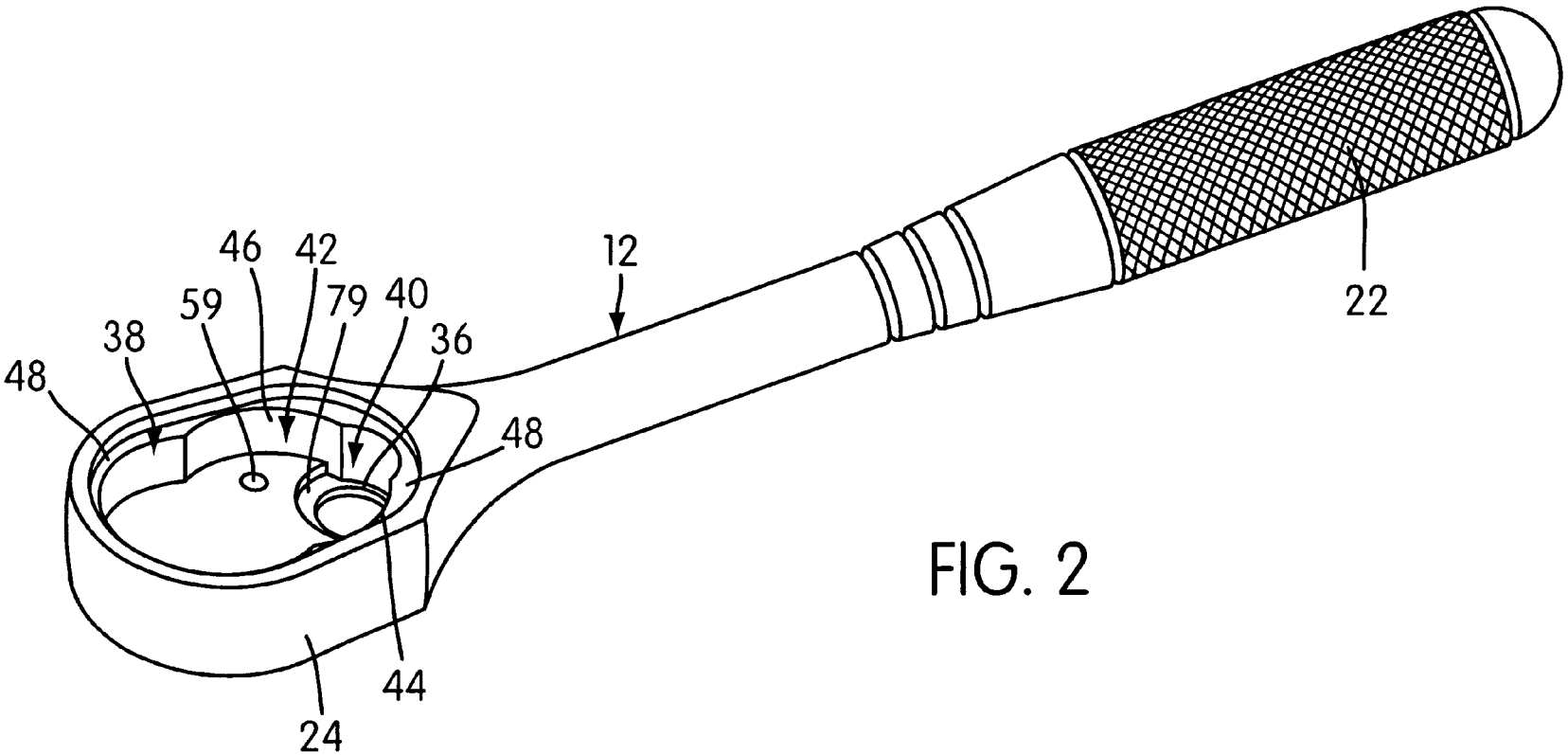
FIG. 2 is a perspective view of the ratchet wrench body of FIG. 1.
Figure 4:
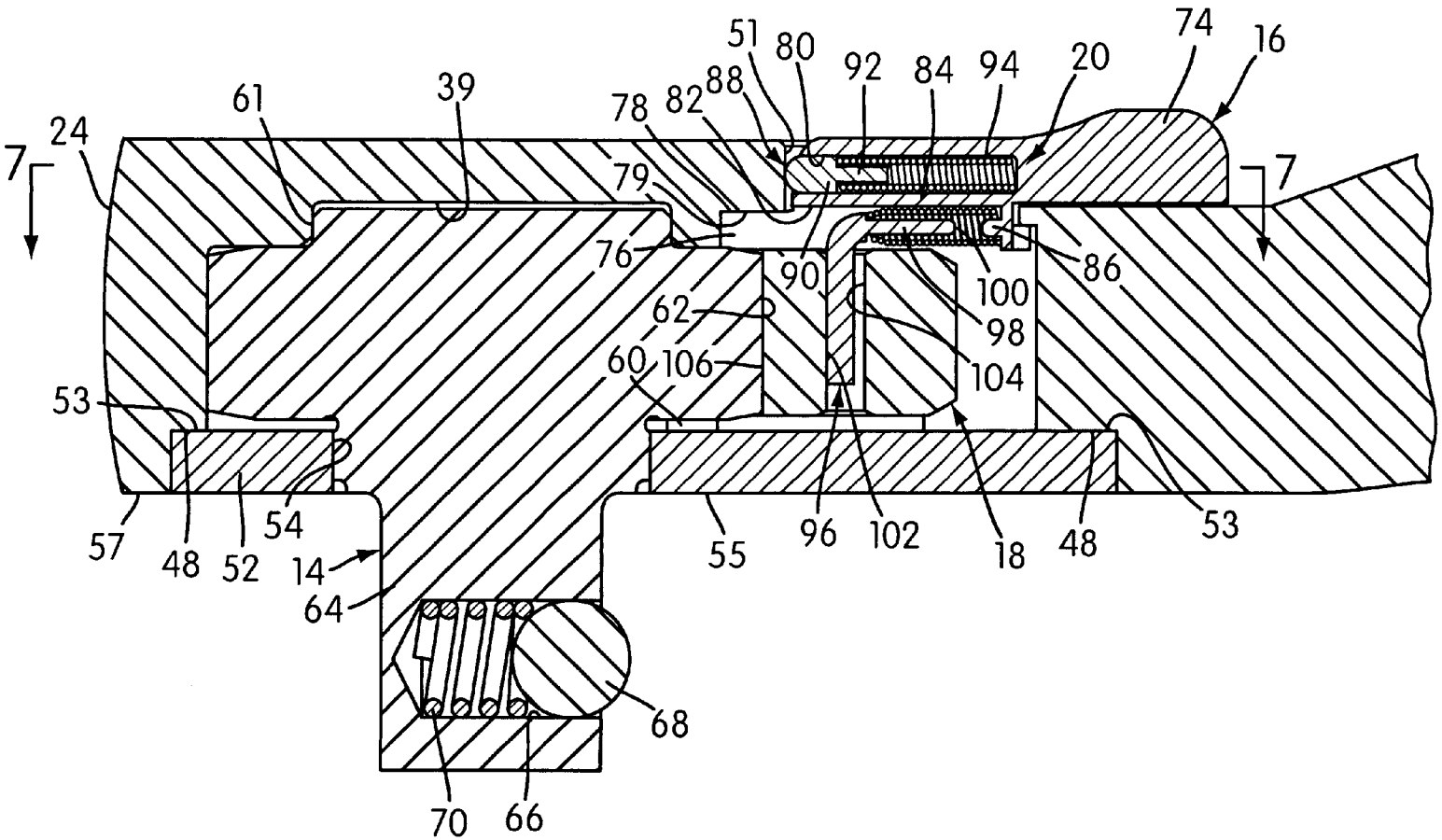
FIG. 4 is a cross sectional view taken along the line 4—4 of FIG. 3.
Figure 5:
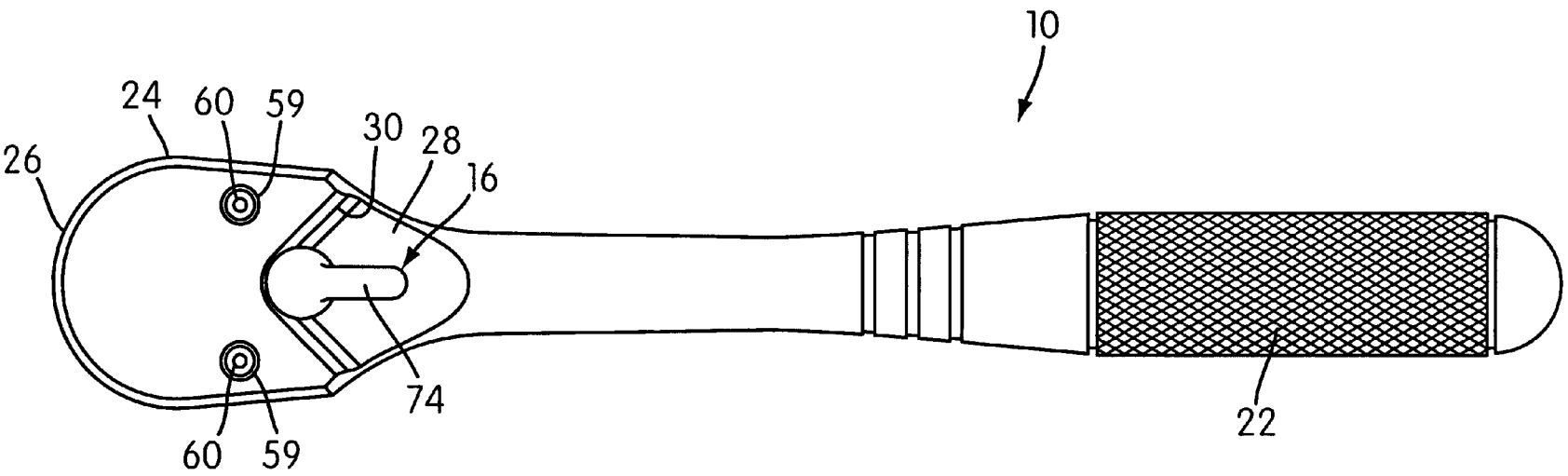
FIG. 5 is a top plan view of the ratchet wrench of FIG. 1.
Figure 6:
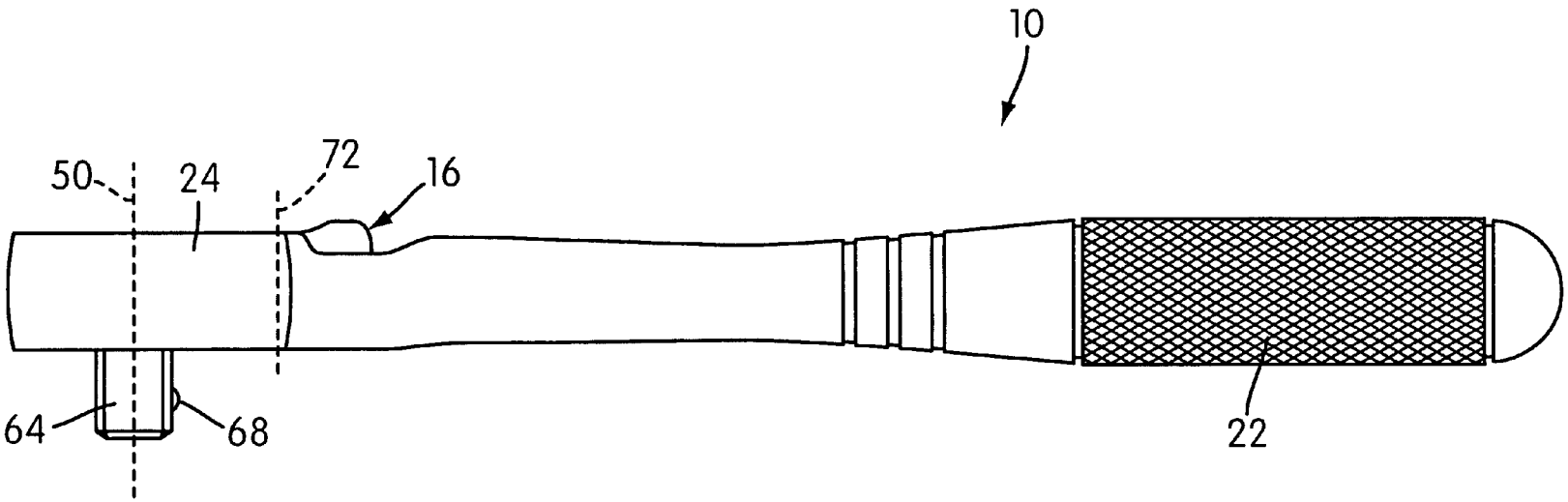
FIG. 6 is a side view of the of the ratchet wrench of FIG. 1.

On an upper wall of the rear portion 28, an opening 36 is provided along the longitudinal axis of the body 12 for receiving the switch member 16. As best shown in FIG. 2, the front portion 26 defines a generally cylindrical gear receiving space 38 that is configured to rotatably receive the torque receiving gear 14 therein. A generally U-shaped gear engaging wall 39 having its opening facing downwardly toward the torque receiving gear 14 (as represented in FIG. 4) is provided to engage an exterior annular wall 61 of the torque receiving gear 14.

The opening 36 extends through the upper wall of the rear portion 28 to a generally annular switch receiving space 40 and a generally cylindrical engaging member receiving space 42 on the opposite side thereof and defined by the interior surface of the ratchet head 24. The engaging member receiving space 42 overlaps the gear receiving space 38 in a generally 8-shaped or bow-tie configuration.

The interior surface of the ratchet head 24 defines the engaging member receiving space 38, which provides spaced apart first and second engaging member abutment surfaces 44, 46, best shown in FIG. 2 and described further below. An inwardly projecting flange 48 extends along the peripheral edge of the gear receiving, switch receiving and engaging member receiving spaces 38, 40 and 42, respectively.

FIGS. 1–4 show the generally annular switch receiving space 40 and the transitional wall 30, which cooperate to provide spaced apart first and second plunger receiving portions 32, 34, described in greater detail below. For reasons which will become appreciated below, the first and second plunger receiving portions 32, 34 are spaced angularly with respect to a gear axis 50 (FIG. 6) about which gear 14 rotates by a semi-annular wall 51.

Figure 1:
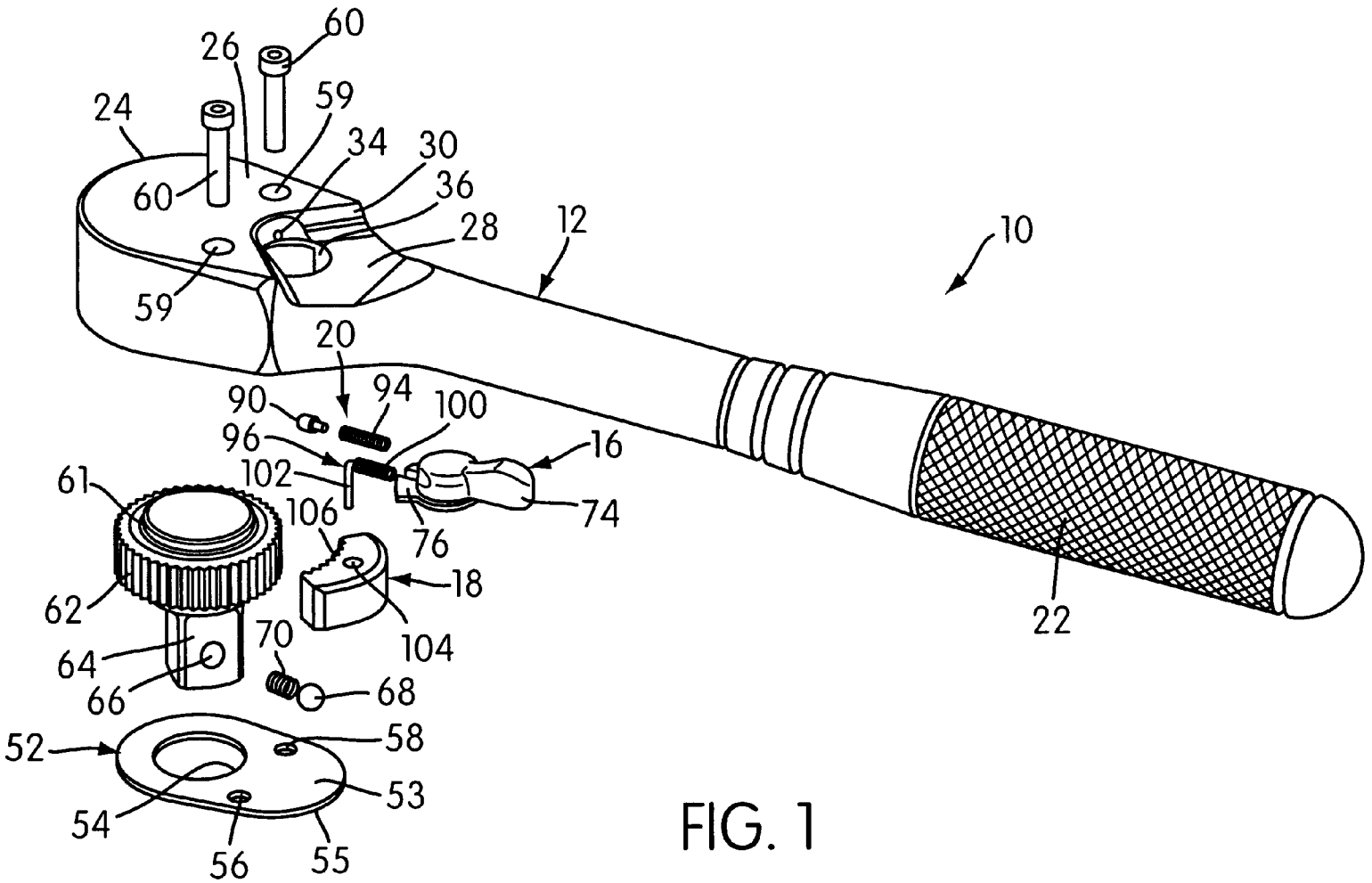
FIG. 1 is a perspective exploded view of a ratchet wrench embodying the principles of the present invention for selectively applying torque to fasteners.
Figure 3:
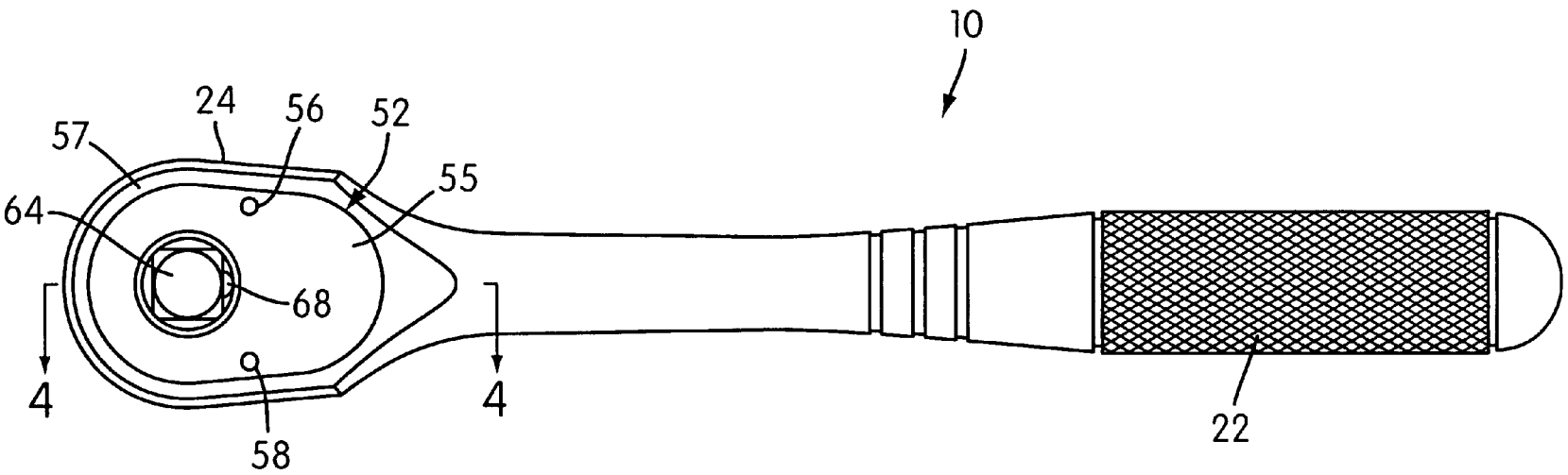
FIG. 3 is a bottom plan view of the ratchet wrench of FIG. 1.

As best shown in FIGS. 1 and 3, a cover plate 52 has a generally 8-shaped or bow-tie configuration complementary to the overlapped configuration of spaces 38, 40 and 42 and is positioned in covering relation over spaces 38, 40, 42 to enclose the torque receiving gear 14 and the gear engaging member 18 as well as the other components associated therewith within the ratchet head 24. The cover plate 52 includes a circular hole 54 generally located in a central area of the cover plate 52 and a pair of spaced fastener receiving portions illustrated in the form of openings 56, 58. The openings 56, 58 are configured to cooperatively engage with fasteners 60, which extend through openings 59 in the ratchet head 24, to secure the cover plate 52 in place with respect to the ratchet head 24. For example, an interior surface 53 of the cover plate 52 may be positioned to abut the inwardly extending flange 48 so that an exterior surface 55 of the cover plate 52 cooperates with an underside or lower surface 57 of the ratchet head 24 to constitute a smooth exterior surface of the ratchet head 24.

The openings 56, 58 may be threaded and the fasteners 60 may threadedly engage the openings 56, 58 to secure the cover plate 52 to the ratchet head 24. Alternatively, in an embodiment not shown, the ratchet head 24 may include an elongated retainer receiving groove provided along the lower edge of the gear receiving space 38 to receive a generally U-shaped snap retaining ring that can be received within the groove to secure the cover plate 52 in place.

The torque receiving gear 14 is rotatable about its gear axis 50 relative to the ratchet head 24 in the gear receiving space 38. The exterior annular wall 61 of the torque receiving gear 14 is spaced from the center of the U-shaped gear engaging wall 39, but rotatably engages the sides thereof, as shown in FIG. 4. The torque receiving gear 14 provides a plurality of gear teeth 62 arranged about the gear axis 50 in a circular arrangement. The torque receiving gear 14 is constructed and arranged to be removably coupled to a rotatable fastener (not shown) in torque transmitting relation such that torque applied to the torque receiving gear 14 is transmitted to the fastener removably coupled therewith to affect rotation of the fastener.

In the illustrated embodiment, the torque receiving gear 14 is a standard ratchet wheel that has a square socket mounting portion 64 extending therefrom for removably mounting a conventional socket, which in turn is then removably coupled to the fastener. Alternatively, the torque receiving gear may be a ring gear with a polygonal socket receiving opening. The torque receiving gear 14 may also be of the type formed integrally with the socket itself and removable with the socket from the wrench body 12.

The socket mounting portion 64 illustrated has an opening 66 therein with a ball bearing 68 slidably received within the opening 66. Biasing member 70 biases the ball bearing 68 into the opening 66, such that the ball bearing 68 can overcome the bias of the biasing member 70. For example, when a socket is received on the socket mounting portion 64, the ball bearing 68 initially compresses the biasing member 70 until the ball bearing 68 can be biased into engagement with a groove on the socket to retain the same thereon. To remove the socket, the user applies a manual force, such as pulling, for example, so that the ball bearing 68 can move against the bias of the biasing member 70 so that the ball bearing 68 retreats radially inwardly as the socket is removed from socket mounting portion 64. The biasing member 70 may be a spring as illustrated or any other resilient structure capable of biasing the ball bearing 68.

Alternatively, as in conventional in the art, a socket releasing trigger having an elongated ball camming portion may be mounted to the gear 14 to be accessible from the exterior of the ratchet wrench 24. As is conventional in the art, a spring may bias the trigger upwardly to cam the surface of the notch on the lower end of the ball camming member against a ball to urge the ball radially outwardly. That way, when a socket would be received on the socket mounting portion, the ball would engage a groove on the socket to retain the same thereon. To remove the socket, the user would depress the trigger against the bias of spring so that the notch on camming portion is positioned to allow the ball to retreat radially inwardly as the socket is removed from socket mounting portion.

As best shown in FIGS. 4, 7 and 8, the switch member 16 is positioned within the switch member receiving opening 40 to be accessible from the exterior of the wrench body 12. The switch member 16 is selectively movable in a pivoting manner about a switching axis between a first switch position and a second switch position about a switch axis 72 (FIG. 6) spaced in the longitudinal direction of the wrench body 12. The switch member 16 provides a thumb engaging portion 74 which the user can engage with his/her thumb to move the switch member 16 between the first and second positions thereof without removing his/her hand from the handle 22.

The switch member 16 includes a mounting flange 76 received within the switch member receiving opening 38, of which an upper forward edge 78 engages a switch engaging surface 79 of the ratchet head 24, as shown in FIG. 2. The switch member 16 also has a generally cylindrical bore 80 open at the forward end thereof that faces generally towards the gear 14 and extends rearwardly into the thumb engaging portion 74. An opening 82 is formed in the underside of the switch member 16 and is vertically spaced from the bore 80 by a dividing wall 84. The opening 82 extends to the front edge of the switch member 16 to provide a continuous opening extending along both the underside and the forward end of the switch member 16. A protrusion 86, in the form of a rounded bump, protrudes forwardly within the opening 82 toward the forward end of the switch member 16. The protrusion 86 is disposed on the switch member 16 to define the rearward end of the opening 82.

A securing member in the form of a plunger 88 includes an enlarged, cavity engaging portion 90 that is configured to be received within the plunger receiving cavities 32, 34 and a narrowed, biasing member engaging portion 92 on which spring 94 is mounted. The plunger 88 is disposed within the bore 80 and is supported by the dividing wall 84 such that the spring 94 biases the enlarged, cavity engaging portion 90 outwardly from the bore 80. The spring 94 bears against the enlarged, cavity engaging portion 90 so as to bias the plunger 88 forwardly and to enable the plunger 88 to be moved rearwardly against the spring 94 relative to the switch member 16 and radially with respect to the switch axis 72. While the enlarged, cavity engaging portion 90 is engaged with or received within the plunger receiving cavities 32, 34, the switch member 16 is securely retained in either its first or second switch position, respectively. The plunger 88 and the spring 94 constitute the securing assembly 20.

An L-shaped mounting element 96 includes a generally horizontal leg 98, on which spring 100 is mounted. The spring 100 and the leg 98 are received in the opening 82 with the rear end of the spring 100 bearing against the protrusion 86 and the front end of the spring 100 bearing against the generally vertical leg 102 of the mounting element 96 so as to bias the mounting element 96 forwardly and enable the mounting element 96 to be moved rearwardly against the spring 100 relative to the switch member 16 and radially with respect to the switch axis 72. The vertical leg 102 extends downwardly into a cylindrical bore 104 formed through the gear engaging member 18.

The gear engaging member 18 has a set of engaging teeth 106 provided in an arcuate and concave arrangement substantially complementary to the circular arrangement of the gear teeth 62 on the torque receiving gear 14. The engaging teeth 106 are configured to be engaged with the gear teeth 62 in intermeshed relation and are shown as such in both FIGS. 7 and 8.

As shown in FIG. 7, the switch member 16 is constructed and arranged in any suitable manner such that selective movement of the switch member 16 into the first position thereof moves the gear engaging member 18 into a first ratcheting position. In the illustrated embodiment, the gear engaging member 18 is connected to the switch member 16 by mounting element 96 such that pivoting the switch member 16 about the switch axis 72 thereof moves the gear engaging member 18 generally circumferentially with respect to the gear axis 50 to its first ratcheting position. During this movement, the teeth of the engaging member 18 remain intermeshed with the teeth of the torque receiving gear 14 so that the circumferential movement of the engaging member 18 rotates the gear 14 about the gear axis. However, if the torque receiving gear 14 is coupled to a fastener in torque transmitting relation, then the teeth of the engaging member 18 ride over the teeth of gear 14 while the gear 14 remains fixed on the fastener. Either way, the engaging member 18 tends to pivot about the mounting element's vertical leg 102, keeping the arcuate teeth of the engaging member 18 in parallel relation with the teeth of the gear 14.

In this first ratcheting position, the plunger 88 is received within the plunger receiving cavity 32 and the spring 100 is disposed in a first spring biasing position wherein at least a component of its biasing force is directed circumferentially with respect to the gear axis 50. As can be seen in FIG. 7, in this illustrated embodiment, the spring 100 is disposed at about 135° with respect to the radius of the gear axis 50 (45° from being absolutely circumferential/tangential).

As best seen in FIG. 4, while traveling between the first and second switch positions, the plunger 88 is biased into engagement with the annular wall 51 that extends between the plunger receiving cavities 32, 34 by the spring 94.

Likewise, as best shown in FIG. 8, selective movement of the switch member 16 into the second position thereof moves the gear engaging member 18 into a second ratcheting position, which is angularly spaced from the first ratcheting position with respect to the gear axis 50. This movement is identical, but opposite to, the movement described above of the gear engaging member 18 into the first ratcheting position.

In this second ratcheting position, the plunger 88 is received within the plunger receiving cavity 34 and the spring 100 is disposed in a second spring biasing position wherein at least a component of its biasing force is directed circumferentially with respect to the gear axis 50. As can be appreciated from comprising FIGS. 7 and 8, these first and second spring biasing positions and first and second ratcheting positions are symmetrical with respect to the longitudinal axis of the wrench body 12.

Referring to FIGS. 7 and 8, the operation of the ratchet wrench 10 and the ratcheting thereof to apply torque to a fastener will be described. The torque receiving gear 14 is removably coupled to a fastener (not shown) in torque transmitting relation via a socket removably mounted to the socket receiving portion 64 of the gear 14. To apply torque to the fastener for rotation thereof, in a counterclockwise direction as viewed in FIG. 7, the switch member 16 is moved the first switch position as shown in FIG. 7 so as to move the plunger element 88 along the annular wall 51 and into engagement with the plunger receiving cavity 32. Moving the switch member 16 into its first switch position also moves the gear engaging member 18 into its first ratcheting position.

When the torque receiving gear 14 is removably coupled to the fastener in torque transmitting relation and the gear engaging member 18 is in the first ratcheting position thereof, a force is manually applied to the handle 22 to affect a first torque applying movement. The first torque movement is counter-clockwise as viewed in FIG. 7. During this first torque applying movement, the gear engaging member 18 abuts against the first engaging member abutment surface 44 to forcibly engage the engaging teeth 106 of the gear engaging member 18 with the gear teeth 62 of the torque receiving gear 14 in intermeshed relation to prevent rotation of the wrench body 12 relative to the torque receiving gear 14. As a result, the force applied to the handle 22 to affect the first torque applying movement is transmitted through the gear engaging member 18 and applied to the torque receiving gear 14 as a torque. This torque is transmitted through the socket mounting portion 64 to affect rotation of the fastener via the torque transmitting relation between the torque receiving gear 14 and the fastener.

When a force is then applied to the handle 22 to affect a movement opposite the first torque applying movement (clockwise in FIG. 7), the force rotates the wrench body 12 relative to the torque receiving gear 14 so that the first engaging member abutment surface 44 moves to a position wherein it allows the gear engaging member 18 to move radially outward with respect to the gear rotational axis 50. In the illustrated embodiment, the abutment surface 44 is moved to provide sufficient spacing to accommodate the radial movement of the engaging member 18. The spring 100 is repeatedly stressed as a result of the wrench body 12 rotating relative to the torque receiving gear 14 while the engaging teeth 106 of the gear engaging member 18 momentarily remain engaged with the gear teeth 62 of the torque receiving gear 14 in intermeshing relation. The engaging teeth 106 and the gear teeth 62 repeatedly interact by camming against one another so as to move the gear engaging member 18 radially outward with respect to the gear axis 50 to disengage the engaging teeth 106 from the gear teeth 62, thereby responsively causing the spring 100 to repeatedly release its stress and move the gear engaging member 18 generally circumferentially with respect to the gear axis 50 with the engaging teeth 106 riding over the gear teeth 62 in a ratcheting manner as a result of the spring 100 being in the first spring biasing position thereof.

To apply torque to a fastener to affect rotation thereof in a clockwise direction as viewed in FIG. 8, the switch member 16 is pivoted to the second switch position thereof as shown in FIG. 8 to move the plunger 88 along the annular wall 51 and into engagement with the plunger receiving cavity 34. Moving the switch member 16 into its second switch position also moves the gear engaging member 18 into its second ratcheting position.

With the torque receiving gear 14 removably coupled to the fastener in torque transmitting relation and the gear engaging member 18 in the second ratcheting position thereof, a force is manually applied to the handle 22 to affect a second torque applying movement. The second torque applying movement is clockwise as viewed in FIG. 8. During this first torque applying movement, the gear engaging member 18 abuts against the second engaging member abutment surface 46 to forcibly engage the engaging teeth 106 of the gear engaging member 18 with the gear teeth 62 of the torque receiving gear 14 in intermeshed relation to prevent rotation of the wrench body 12 relative to the torque receiving gear 14. The force applied to the handle 22 to affect the second torque applying movement is transmitted through the gear engaging member 18 and applied to the torque receiving gear 14 as a torque which, in turn, is transmitted through the socket mounting portion 64 to affect rotation of the fastener via the torque transmitting relation between the torque receiving gear 14 and the fastener.

When a force is then applied to the handle 22 to affect a movement opposite the second torque applying movement (counter-clockwise in FIG. 8) the force rotates the wrench body 12 relative to the torque receiving gear 14 so that the second engaging member abutment surface 46 moves to a position wherein it allows the gear engaging member 18 to move radially outward with respect to the gear rotational axis 26 in the same manner as described above with respect to FIG. 7 to enable the wrench body 12 to rotate relative to the gear 14 with the engaging member 18 riding over the gear teeth of gear 14 in a ratcheting manner.

Because the switch member 16 is secured into either its first or second switch positions by the securing assembly 20 (i.e., the plunger 88 and the spring 94), the switch member 16 does not move or have a tendency to move when the ratchet wrench 10 is in operation. Additionally, the engaging member 18 is not fixed directly to the switch member 16 and instead is connected thereto by spring 100, the ratcheting movement of the engaging member 18 does not move the switch member 16 itself.

Other embodiments of the wrench 10 will be described below. In the descriptions of the further embodiments, only the points of difference will be described. That is, in those embodiments, the constituent components the same as those in the above-described embodiment are referenced correspondingly in the drawings and further description about them will be omitted.

FIGS. 9–17 show a ratchet wrench 210, which has an alternative construction from the ratchet wrench 10, including spaced detents illustrated in the form or recesses 242, 244 to secure a switch member 216 in either its first or second switch position.

The ratchet wrench 210 comprises a metal wrench body, generally indicated at 212, the torque receiving gear 14, the switch member 216, the gear engaging member 18 and the spring 100. Since the switch member 16 is similar in construction and operation to the switch member 216 (except that switch member 16 has the opening 82 formed therein), the switch member 16 could be used to replace the switch member 216.

The wrench body 212 provides an elongated manually engageable handle 222 configured for manual grasping thereof and a ratchet head 224 provided on the handle 222.In the illustrated embodiment, the handle 222 and the head 224 are integrally formed together. However, the invention is not limited to such an arrangement and may cover two-piece constructions wherein the head is movable relative to the handle 222.

Figure 10:
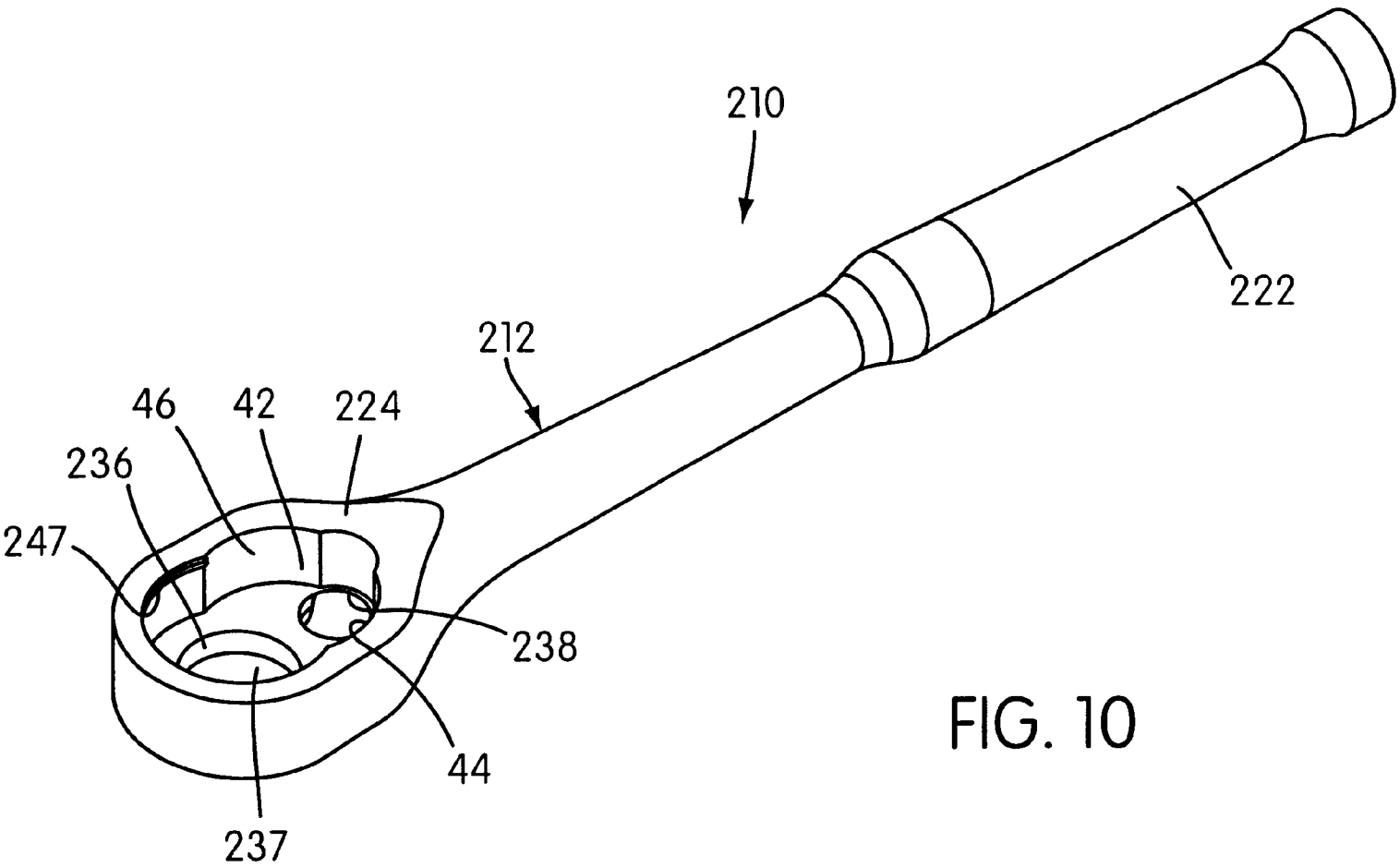
FIG. 10 is a perspective view of the ratchet wrench body of FIG. 9.
Figure 11:
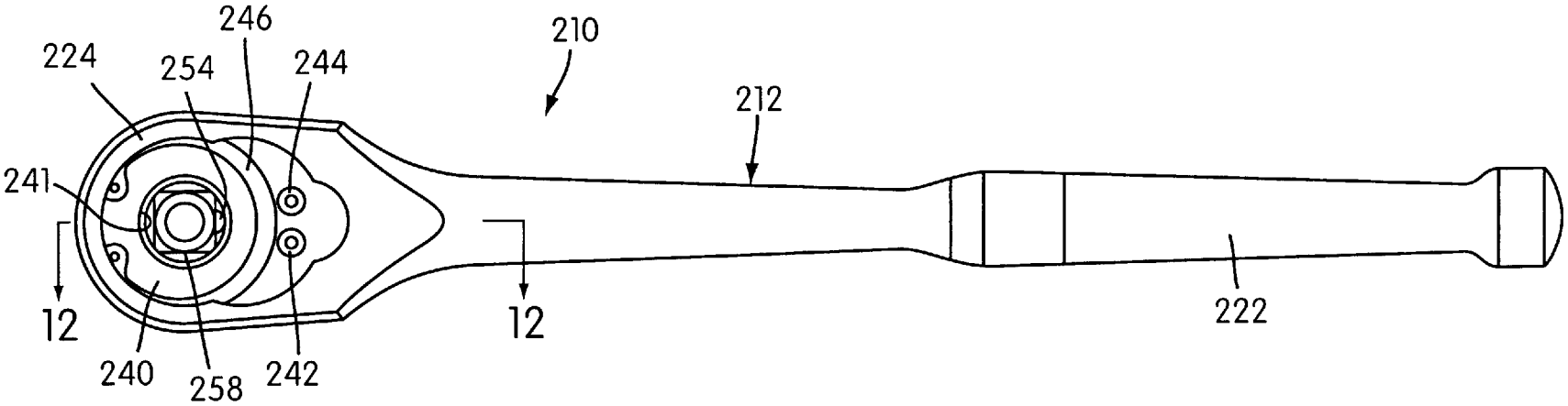
FIG. 11 is a bottom plan view of the ratchet wrench of FIG. 9.
Figure 12:
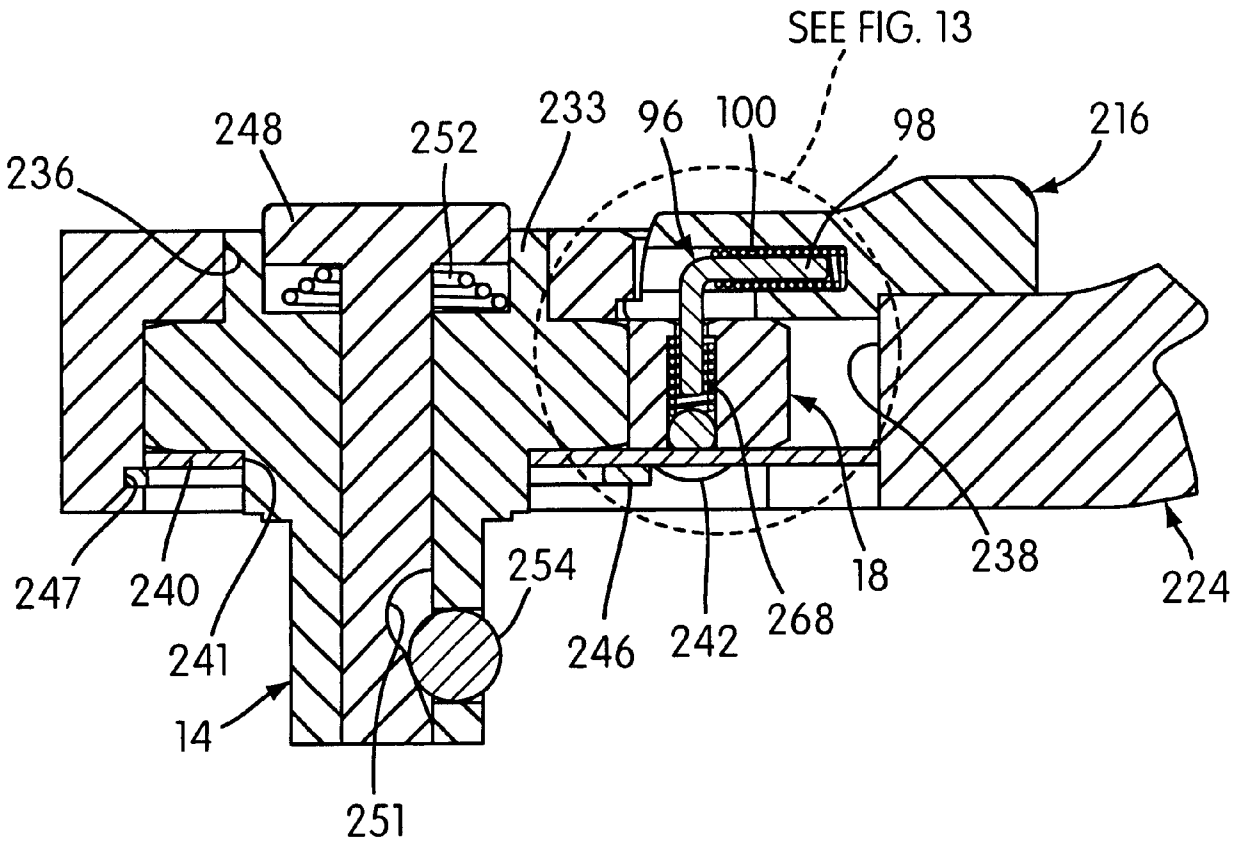
FIG. 12 is a cross sectional view taken along the line 12—12 of FIG. 11.

As best shown in FIGS. 9–12, the ratchet head 224 provides a pair of openings 236, 238 on the upper wall generally positioned along the longitudinal axis of the body 212, the first of which receives an annular upper wall 233 of the torque receiving gear 14 and the second of which receives the mounting flange 76 of the switch member 216. As best shown in FIG. 12, the opening 236 extends through the upper wall of the ratchet head 224 to a generally cylindrical gear receiving space 38 that is configured to rotatably receive the torque receiving gear 14 therein. The opening 238 extends through the upper wall of the ratchet head 24 to a generally cylindrical engaging member receiving space 42 on the opposite side thereof. The interior surface of the ratchet head 224 defining the engaging member receiving space 42 provides the spaced apart first and second engaging member abutment surfaces 44, 46, best shown in FIGS. 16 and 17 and described further below. The ratchet head 224 also has an elongated retainer receiving groove 247 provided along the lower edge of the gear receiving space 38.

Figure 9:
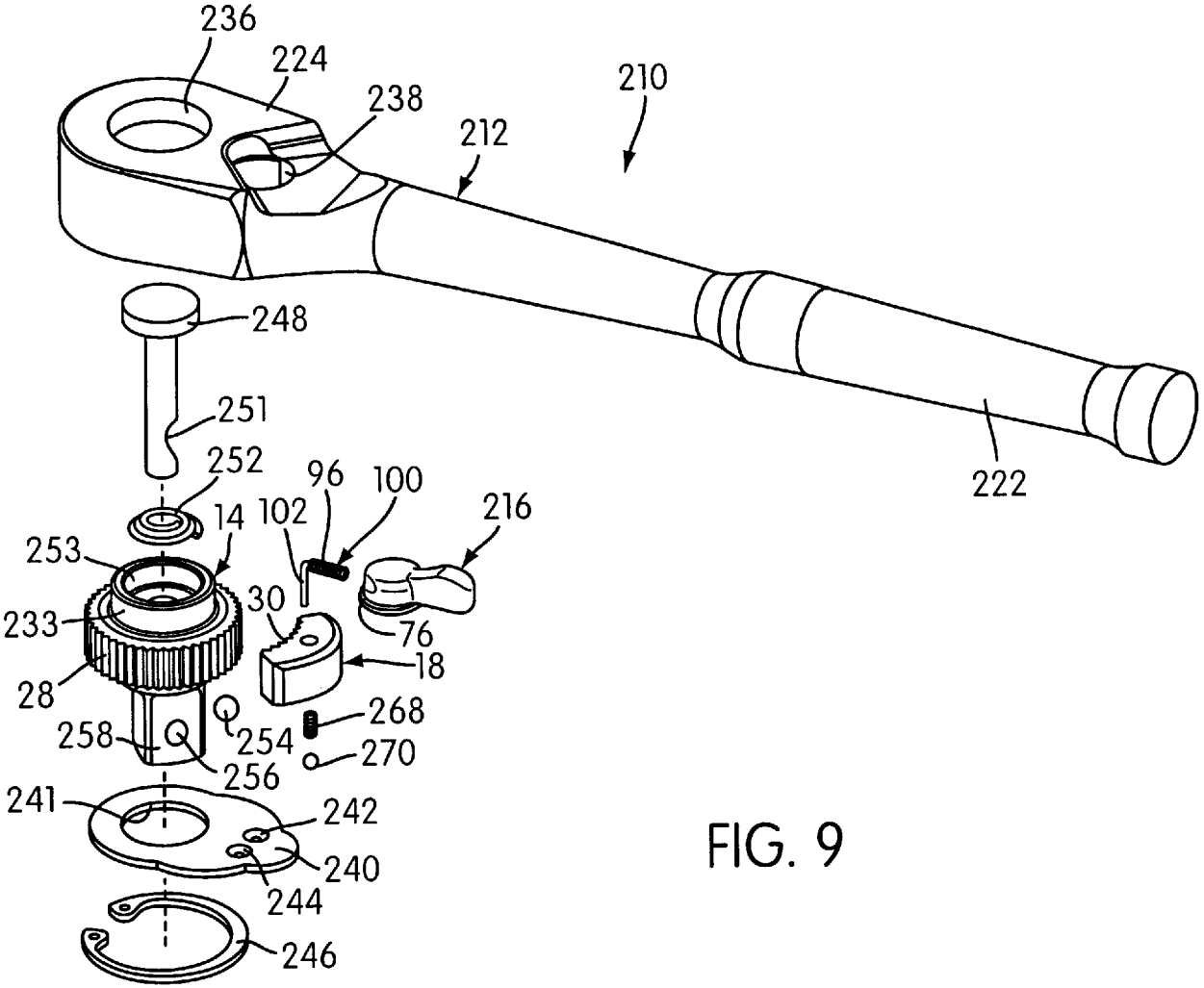
FIG. 9 is a perspective exploded view of an alternative embodiment of the ratchet wrench shown in FIG. 1 embodying the principles of the present invention for selectively applying torque to fasteners.

As best shown in FIGS. 9 and 11, a cover plate 240 includes a circular hole 241 and a pair of spaced detents illustrated in the form of recesses 242, 244. For reasons which will become appreciated below, the recesses 242, 244 are spaced angularly with respect to the gear axis 50. The cover plate 240 has a generally 8-shaped or bow-tie configuration complementary to the overlapped configuration of spaces 38 and 42 and is positioned in covering relation over spaces 38 and 42 to enclose the torque receiving gear 14 and the gear engaging member 18 and the other components associated therewith within the ratchet head 224. The cover plate 240 is secured in place by a generally U-shaped snap retaining ring 246 that is received within groove 247.

Alternative to the socket mounting portion 64, socket mounting portion 258 has an opening 256 therein with a ball bearing 254 slidably received within the opening 256. A socket releasing trigger 248 is mounted to the gear 14. As best shown in FIGS. 9 and 12, the socket releasing trigger 248 has an elongated ball camming portion 251 extending into an elongated cavity 253 in the torque receiving gear 14. A coil spring 52 is disposed between the underside of the head of the socket releasing trigger 248 and a spring seat surface on the torque receiving gear 14 adjacent the annular wall 233 thereof. As can be best seen in FIG. 12, and as is conventional in the art, the spring 252 biases the trigger 248 upwardly to cam the surface of the notch on the lower end of the ball camming member 251 against the ball to urge it radially outwardly. When a socket is received on the socket mounting portion 258, the ball engages a groove on the socket to retain the same thereon. To remove the socket, the user depresses the trigger 248 against the bias of spring 252 so that the notch on camming portion 251 is positioned to allow the ball to retreat radially inwardly as the socket is removed from socket mounting portion 258.

Figure 13:
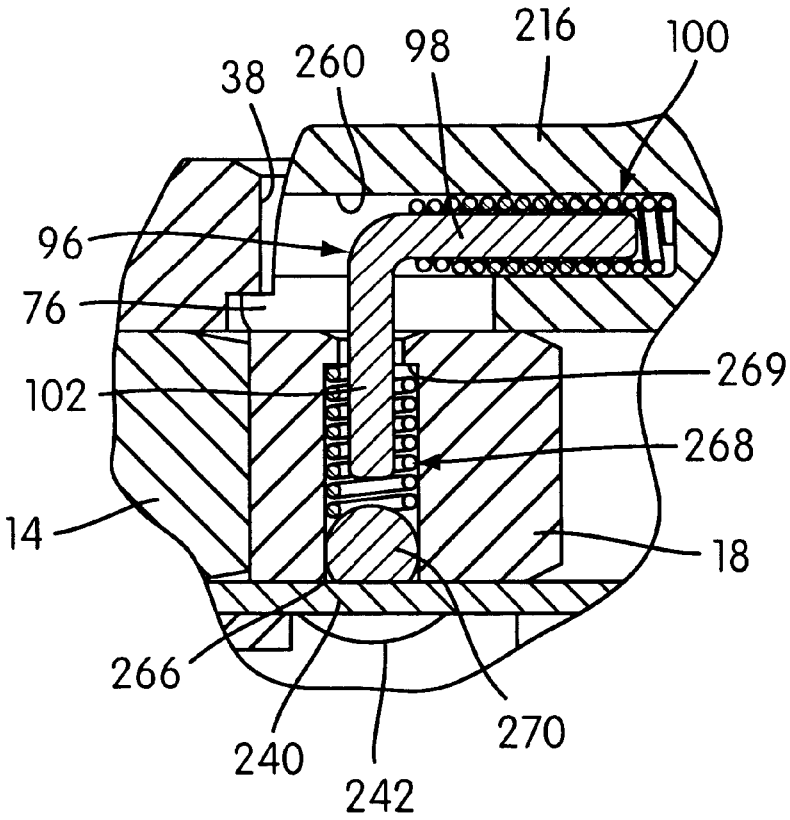
FIG. 13 is a partial enlarged cross sectional view showing the details in the area marked 13—13 in FIG. 12.
Figure 14:
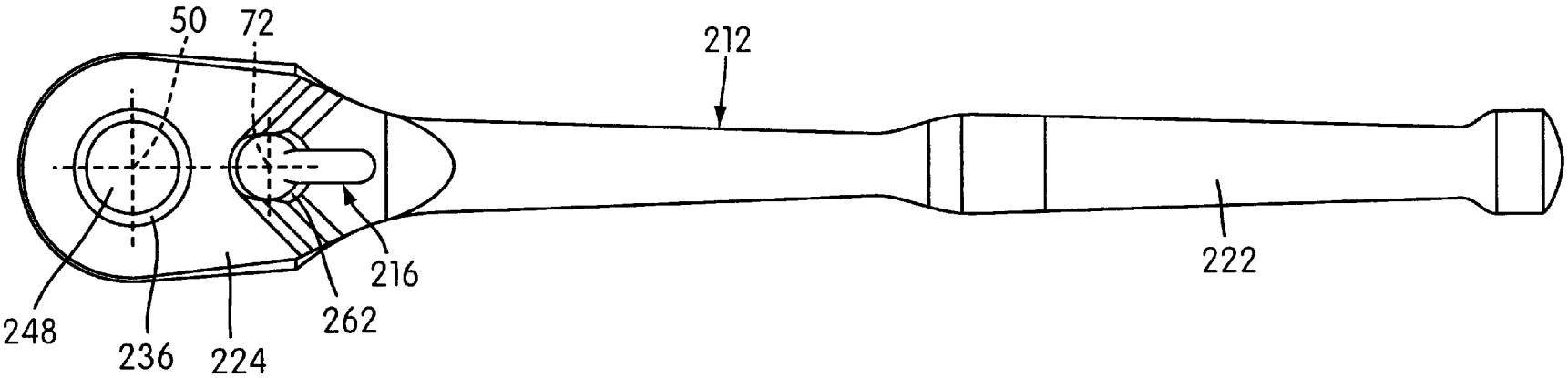
FIG. 14 is a top plan view of the ratchet wrench of FIG. 9.
Figure 15:
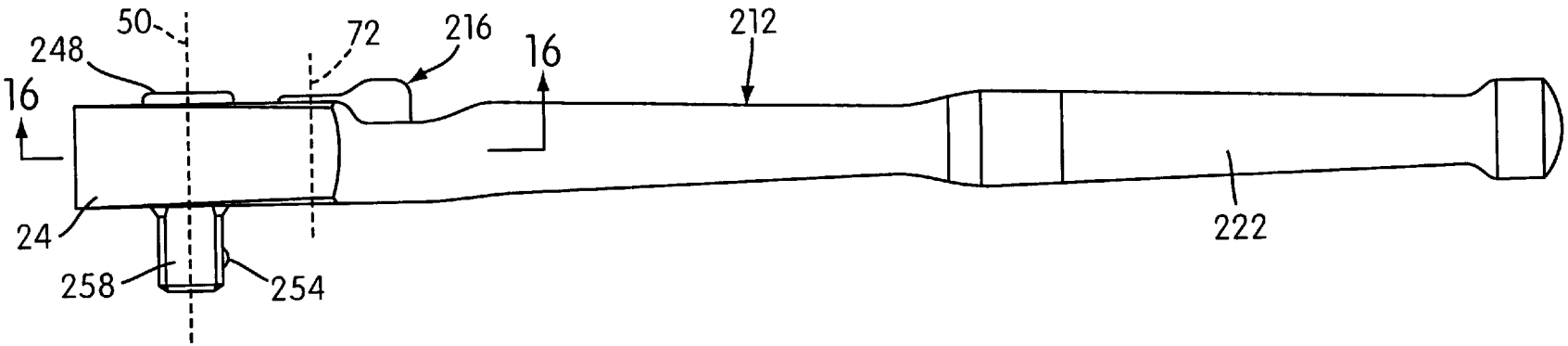
FIG. 15 is a side view of the of the ratchet wrench of FIG. 9.

As described above, the L-shaped mounting element 96 has the vertical leg 102 which extends downwardly into the cylindrical bore 104 formed through the gear engaging member 18. As best seen in FIGS. 9, 13 and 14, a retaining spring 268 is received over the vertical leg 102 of the mounting element 96 and bears against a spring seat 269 provided in the bore 104. An engaging member retaining member 270 in the form of a spherical ball bearing is received in the end of the bore 104 with the lower end of the spring 268 bearing thereagainst so as to bias the ball bearing 270 downwardly against the interior surface of cover plate 240.

The broader aspects of the invention are not limited to the use of the mounting element 96 and the ball bearing 270.

Method of Manufacture

It is contemplated that each ratchet wrench 210 embodying the principles of the present invention may be individually made generally in accordance with the following method. The horizontal leg 98 of the mounting element 96 is inserted through spring 100 and then the spring 100 and the leg 98 are inserted into the switch member opening 82 as shown in FIGS. 12 and 13. Then, the mounting flange 76 of the switch member 216 is inserted in the switch member receiving opening 38 so that the vertical leg 102 of the mounting element 96 extends into the engaging member receiving space 42. The switch member 216 is held in this position by, for example, an assembly worker putting his/her thumb or finger over the switch member 216. Then the wrench body 212 is positioned in an upside down position or inverted as shown in FIG. 10 with the engaging member receiving space 42 facing generally upwardly.

Once the wrench body 212 is inverted as shown in FIG. 10, the assembly worker positions the gear engaging member 18 in the generally upwardly facing engaging member receiving space 42 such that the vertical leg 102 of the mounting element 96 is received in the engaging member's bore 104. The torque receiving gear 14 with the trigger 248 and its associated components mounted thereto is then positioned in the gear receiving space 38 such that the releasing trigger 248 is accessible through the opening 236. By positioning the engaging gear 18 in the receiving space 42 before positioning the torque receiving gear 14 in the receiving space 38, assembly is made easier because the torque receiving gear 14 will automatically engage the engaging member 18 and push it radially against the bias of spring 100 to accommodate ingress of the torque receiving gear 14. It is possible within the scope of the invention to position the receiving gear 14 in space 38 prior to positioning the engaging member 18 in space 42; however, that requires the assembly worker to manually push the engaging gear 18 against the bias of spring 100 to accommodate its ingress into space 38.

The retaining spring 268 is then positioned in the bore 104 and received over vertical leg 102 with the spring end that is normally the upper end engaging the spring seat 269 provided in the bore 104. The retaining member 270 is then positioned in the bore 104 atop the spring 268. The cover member 240 is then positioned in covering relation over both the generally upwardly facing gear receiving space 38 and the generally upwardly engaging member receiving space 42 as shown in FIGS. 2 and 4. Finally, the cover member 240 is secured in its covered relation by inserting a well-known snap retaining member 246 in groove 247 so as to retain the gear engaging member 18 in the rear receiving space 42, the retaining spring 268 and the retaining member 270 in the bore 104, and the gear 14 in the gear receiving space 38.

The operations of positioning the retaining member 270 and retaining spring 268 in bore 104 may take place before or after the gear engaging member 18 is positioned in the space 42. If these operations are done before the engaging member 18 is placed in the space 42, then the engaging member 18 should be maintained in an inverted position to prevent loss of the retaining member 270 and spring 268.

By assembling the ratchet wrench in the above described manner, the spring 268 and the retaining member 270 are less likely to be dropped by assembly workers. With less parts being dropped, less materials and time are wasted, thus increasing efficiency and overall cost effectiveness of manufacturing.

Figure 16:
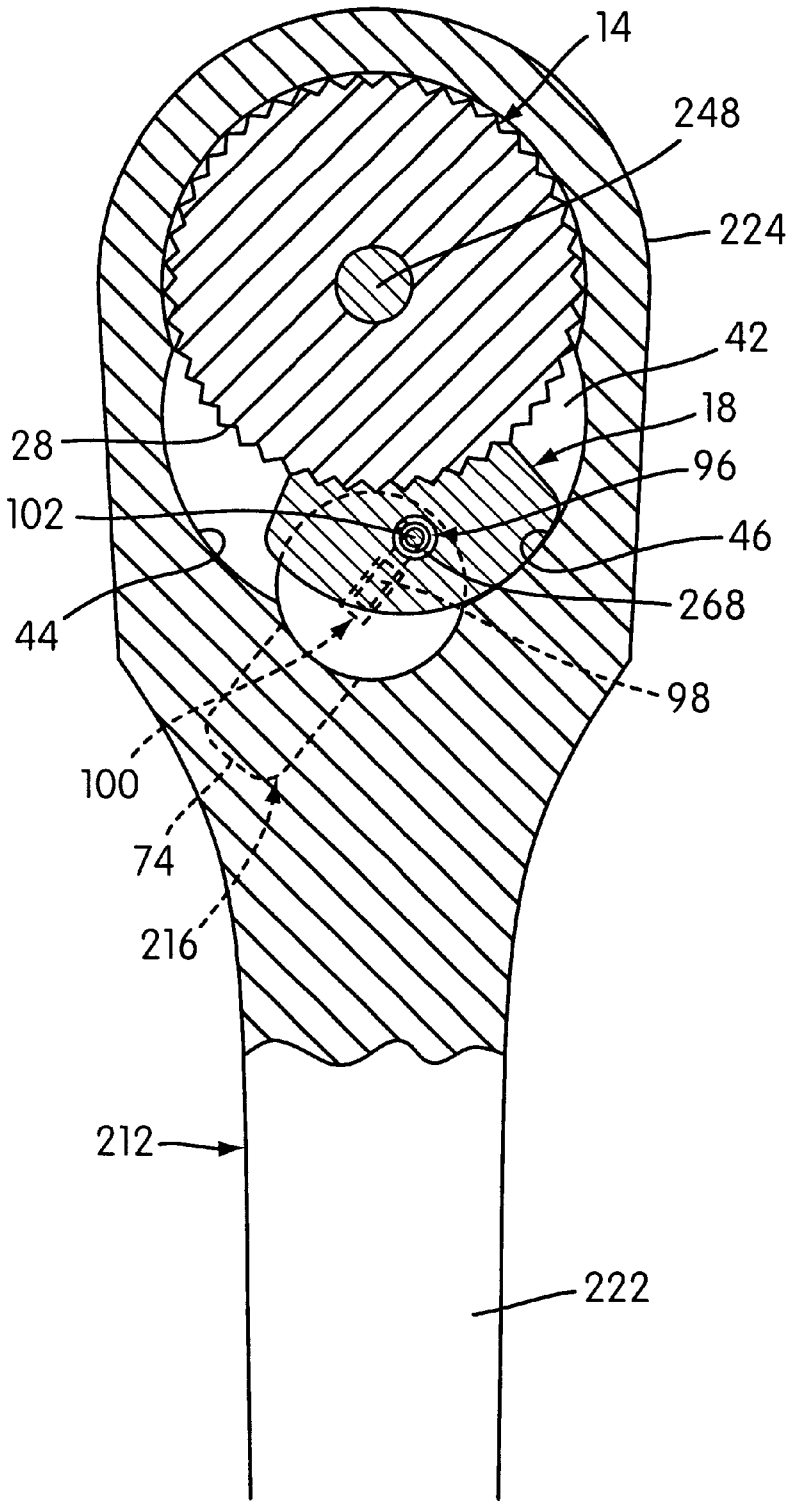
FIG. 16 is a cross sectional view taken along the line 16—16 of FIG. 15 showing the gear engaging member in a first ratcheting position thereof.
Figure 17:
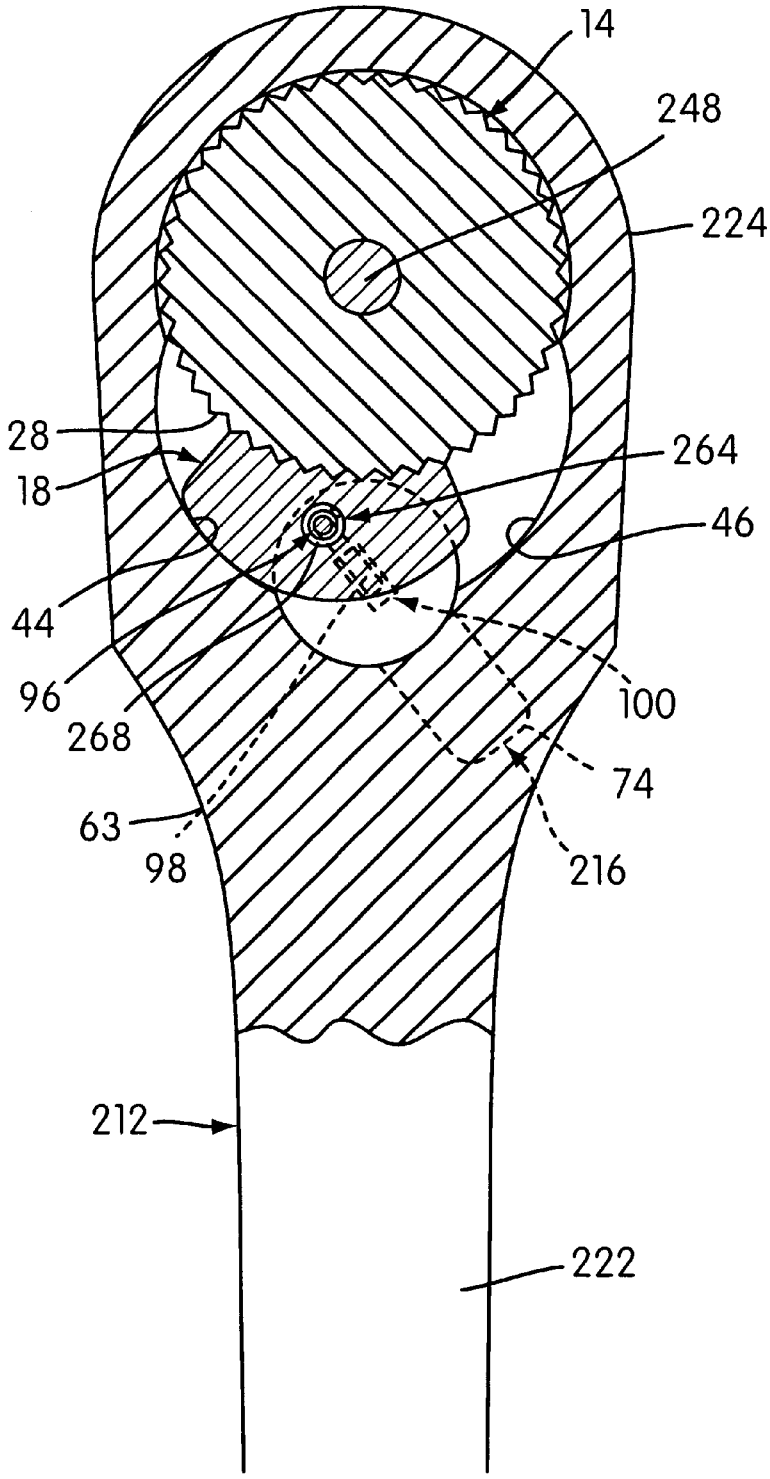
FIG. 17 is a cross sectional view similar to FIG. 16, but showing the gear engaging member in a second ratcheting position thereof.

The operation of the ratchet wrench 210 and the ratcheting thereof to apply torque to a fastener is shown in FIGS. 16 and 17. Since the operation of the ratchet wrench 210 is identical to the operation of the ratchet wrench 10 for applying torque to a fastener, only the operation of securing the switch member 216 using the detents 242, 244 will be described below.

To apply torque to a fastener to affect rotation thereof in a counterclockwise direction as viewed in FIG. 16 when using ratchet wrench 210, the switch member 216 is pivoted to the first switch position thereof as shown in FIG. 16 to move the spring 268 and the retaining member 270 into engagement with the recess 242. Moving the switch member 216 into its first switch position also moves the gear engaging member 18 into its first ratcheting position, as described above in relation with ratchet wrench 10.

To apply torque to a fastener to affect rotation thereof in a clockwise direction as viewed in FIG. 17, the switch member 216 is pivoted to the second switch position thereof as shown in FIG. 17 to move the spring 268 and the retaining member 270 into engagement with the recess 244. Moving the switch member 216 into its second switch position also moves the gear engaging member 18 into its second ratcheting position, as described above in relation with ratchet wrench 10.

Because the engaging member 18 is not fixed directly to the switch member 216 and instead is connected thereto by spring 100 in ratchet wrench 210, the ratcheting movement of the engaging member 18 does not move the switch 216 itself.

While the principles of the invention have been made clear in the illustrative embodiments set forth above, it will be obvious to those skilled in the art to make various modifications to the structure, arrangement, proportion, elements, materials, and components used in the practice of the invention.

Any U.S. patents mentioned herein above and not specifically incorporated by reference and U.S. Provisional Application of Daigle et al., Ser. No. 60/189,054, filed Mar. 14, 2000, are hereby incorporated into the present application by reference.

It will thus be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed:

1. A ratchet wrench for selectively applying torque to fasteners, said ratchet wrench comprising:

a wrench body comprising (a) an elongated manually engageable handle configured for manual grasping thereof and (b) a ratchet head provided on said handle, said wrench body providing spaced apart first and second engaging member abutment surfaces;

a torque receiving gear mounted for rotation about a gear axis relative to said ratchet head, said torque receiving gear providing a plurality of gear teeth provided about said gear axis in a circular arrangement;

said torque receiving gear being constructed and arranged to be removably coupled to a rotatable fastener in torque transmitting relation such that torque applied to said torque receiving gear is transmitted to the fastener removably coupled therewith to affect rotation of the fastener;

a switch member mounted externally to said wrench body to be accessible from an exterior of said wrench body, said switch member being selectively movable between a first switch position and a second switch position;

a gear engaging member having a set of engaging teeth provided in an arcuate and concave arrangement substantially complementary to the circular arrangement of said gear teeth, said engaging teeth being configured to be engaged with said gear teeth in intermeshed relation.

a mounting element mounting said gear engaging member to said switch element, said gear engaging member being pivotally mounted to said mounting element such that selective movement of said switch member into said first position thereof moves said gear engaging member into a first ratcheting position and selective movement of said switch member into said second position thereof moves said gear engaging member into a second ratcheting position angularly spaced from said first ratcheting position with respect to said gear axis, said pivotal mounting of said gear engaging member enabling said gear engaging member to pivot relative to said mounting element as said gear engaging member moves between said first and second ratcheting positions thereof;

said gear engaging member being constructed and arranged such that, when said torque receiving gear is removably coupled to a rotatable fastener in torque transmitting relation as aforesaid and said gear engaging member is in said first ratcheting position thereof, a force applied to said handle to affect a first torque applying movement abuts said gear engaging member against said first abutment surface to forceably engage the engaging teeth of said gear engaging member with the gear teeth of said torque receiving gear in intermeshed relation to prevent rotation of said wrench body relative to said torque receiving gear so that the force applied to said handle to affect the first torque applying movement is transmitted through said gear engaging member and applied to said gear as a torque which is transmitted to the fastener to affect rotation thereof via the torque transmitting relation between said gear and the fastener;

said gear engaging member being constructed and arranged such that, when said torque receiving gear is removably coupled to a rotatable fastener in torque transmitting relation as aforesaid and said gear engaging member is in said second ratcheting position thereof, a force applied to said handle to affect a second torque applying movement abuts said gear engaging member against said second abutment surface to forceably engage the engaging teeth of said gear engaging member with the gear teeth of said torque receiving gear to prevent rotation of said wrench body relative to said torque receiving gear so that the force applied to said handle to affect the second torque applying movement is transmitted through said gear engaging member and applied to said gear as a torque which is transmitted to the fastener to affect rotation thereof via the torque transmitting relation between said ratchet gear and the fastener;

a spring engaged between said switch member and said mounting element so as to apply a biasing force to said gear engaging member through said mounting element, wherein said switch member has a bore formed therein and wherein said gear engaging member has a bore formed therein, said mounting element being L-shaped having a first leg received in the bore of said switch member and a second leg received in the bore of said gear engaging member, said spring being positioned between said mounting element and said switch member such that, (a) when said gear engaging member is in said first ratcheting position, said spring is disposed in a first spring biasing position so that at least a component of the biasing force is directed circumferentially with respect to said gear axis and (b) when said gear engaging member is in said second ratcheting position, said spring is disposed in a second spring biasing position so that at least a component of the biasing force is directed circumferentially with respect to said gear axis;

said gear engaging member and said spring being constructed and arranged such that, when said torque receiving gear is removably coupled to a rotatable fastener in torque transmitting relation as aforesaid and said gear engaging member is in said first ratcheting position thereof, a force applied to said handle to affect a movement opposite the first torque applying movement rotates said wrench body relative to said torque receiving gear so that (a) said first abutment surface moves to a position wherein it allows said gear engaging member to move radially outward with respect to said rotational axis to permit said engaging teeth to disengage from said gear teeth, and (b) said engaging member moves generally circumferentially with respect to said gear axis with the engaging teeth thereof ratcheting over said gear teeth;

said gear engaging member and said spring being constructed and arranged such that, when said torque receiving gear is removably coupled to a rotatable fastener in torque transmitting relation as aforesaid and said gear engaging member is in said second ratcheting position thereof, a force applied to said handle to affect a movement opposite the second torque applying movement rotates said wrench body relative to said torque receiving gear so that (a) said second abutment surface moves to a position wherein it allows said gear engaging member to move radially outward with respect to said rotational axis to permit said engaging teeth to disengage from said gear teeth, and (b) said engaging member moves generally circumferentially with respect to said gear axis with the engaging teeth thereof ratcheting over said gear teeth.

2. A ratchet wrench according to claim 1, wherein said spring is received in the bore of said switch member between said mounting element and an interior surface of the bore of said switch member.

3. A ratchet wrench according to claim 2, wherein said spring is a coil spring slidably received on the first leg of said mounting element.

4. The ratchet wrench of claim 1, wherein said wrench body provides spaced apart first and second securing member receiving portions and said switch member has a securing member cooperable with each of said first and second securing member receiving portions such that (a) movement of said switch member into said first position thereof moves said securing member into engagement with said first securing member receiving portion to releasably retain said switch member in said first switch position thereof and said gear engaging member in said first ratcheting position thereof and (b) selective movement of said switch member into said second position thereof moves said securing member into engagement with said second securing member receiving portion to releasably retain said switch member in said second switch position thereof and said gear engaging member in said second ratcheting position thereof.

5. A ratchet wrench according to claim 1, wherein said wrench body has an interior surface defining an engaging member receiving space and providing said spaced apart first and second engaging member abutment surfaces, and wherein said gear engaging member is received in said engaging member receiving space;

said ratchet wrench further comprising:

a cover member positioned in covering relation with respect to said engaging member receiving space, said cover member having a pair of spaced apart fastener receiving portions configured to receive fasteners, said fastener receiving portions and said fasteners cooperating to retain said gear engaging member within said engaging member receiving space.

6. The ratchet wrench of claim 5, further comprising a spring operatively coupled to said switch member and said securing member to apply a biasing force to said securing member such that, when said securing member is received within the first or second securing member receiving portion, the spring applies a biasing force to said securing member to retain the securing member in the first or second securing member receiving portion and to retain the switch member in its first or second switch position, respectively.

7. A ratchet wrench according to claim 6, wherein said spaced apart first and second securing member receiving portions and said securing member are constructed and arranged such that (a) when said switch is in said first switch position thereof, said securing member is received in said first securing member receiving portion to releasably retain said switch at said first switch position thereof until a force sufficient to urge said securing member against said spring and out of said first securing member receiving portion is applied to said switch member and (b) when said switch is in said second switch position thereof, said securing member is received in said second securing member receiving portion to releasably retain said switch member at said second switch position thereof until a force sufficient to urge said switch against said spring and out of the second securing member receiving portion is applied to said switch member.

8. A ratchet wrench for selectively applying torque to fasteners, said ratchet wrench comprising:

a wrench body comprising (a) an elongated manually engageable handle configured for manual grasping thereof and (b) a ratchet head provided on said handle, said wrench body having an upper wall portion providing spaced apart first and second securing member receiving portions;

a torque receiving gear mounted for rotation about a gear axis relative to said ratchet head, said torque receiving gear being constructed and arranged to be removably coupled to a rotatable fastener in torque transmitting relation such that torque applied to said torque receiving gear is transmitted to the fastener removably coupled therewith to affect rotation of the fastener, said torque receiving gear having a plurality of gear teeth;

a gear engaging member having one or more engaging teeth configured to be engaged with said gear teeth in intermeshed relation, said gear engaging member being movable between (A) a first ratcheting position wherein said one or more engaging teeth engage said gear teeth in said intermeshed relation such that (1) force applied to said handle in a first torque applying direction is transmitted through said gear engaging member and applied as torque about said gear axis to said torque receiving gear, and (2) force applied to said handle in a second torque applying direction moves said wrench body relative to said gear with said one or more engaging teeth ratcheting over said gear teeth, and (B) a second ratcheting position wherein said engaging teeth engage said one or more gear teeth in said intermeshed relation such that (1) force applied to said handle in said second torque applying direction is transmitted through said gear engaging member and applied as torque to said torque receiving gear, and (2) force applied to said handle in said first torque applying direction moves said wrench body relative to said gear with said one or more engaging teeth ratcheting over said gear teeth;

a switch member mounted externally to said wrench body and operatively coupled to the upper wall portion of the wrench body to be accessible from an exterior of said wrench body, said switch member being operatively coupled to said gear engaging member and selectively movable between a first switch position to move said gear engaging member to said first ratcheting position thereof and a second switch position to move said gear engaging member to said second ratcheting position thereof; and said switch member having a securing member cooperable with each of said first and second securing member receiving portions such that (a) movement of said switch member into said first position thereof moves said securing member into engagement with said first securing member receiving portion to releasably retain said switch member in said first switch position thereof and said gear engaging member in said first ratcheting position thereof and (b) selective movement of said switch member into said second position thereof moves said securing member into engagement with said second securing member receiving portion to releasably retain said switch member in said second switch position thereof and said gear engaging member in said second ratcheting position thereof.

9. The ratchet wrench of claim 8, wherein said gear engaging member is movable relative to said switch member and biased into engagement with said gear teeth so as to enable said gear engaging member to ratchet over said gear teeth without moving said switch member.

10. The ratchet wrench of claim 9, wherein said wrench body provides spaced apart first and second engaging member abutment surfaces and wherein said gear engaging teeth of said gear engaging member are provided in an arcuate concave arrangement substatntially complimentary to the circular arrangement of said gear teeth;

said gear engaging member is constructed and arranged such that, when said torque receiving gear is removably coupled to the rotatable fastener in torque transmitting relation and said gear engaging member is in said first ratcheting position thereof, a force applied to said handle to affect a first torque applying movement abuts said gear engaging member against said first abutment surface to forceably engage the engaging teeth of said gear engaging member with the gear teeth of said torque receiving gear in intermeshed relation to prevent rotation of said wrench body relative to said torque receiving gear so that the force applied to said handle to affect the first torque applying movement is transmitted through said gear engaging member and applied to said gear as a torque which is transmitted to the fastener to affect rotation thereof via the torque transmitting relation between said gear and the fastener, said gear engaging member being constructed and arranged such that, when said torque receiving gear is removably coupled to a rotatable fastener in torque transmitting relation as aforesaid and said gear engaging member is in said second ratcheting position thereof, a force applied to said handle to affect a second torque applying movement abuts said gear engaging member against said second abutment surface to forceably engage the engaging teeth of said gear engaging member with the gear teeth of said torque receiving gear to prevent rotation of said wrench body relative to said torque receiving gear so that the force applied to said handle to affect the second torque applying movement is transmitted through said gear engaging member and applied to said gear as a torque which is transmitted to the fastener to affect rotation thereof via the torque transmitting relation between said ratchet gear and the fastener;

said wrench further comprising:

a spring coupled to said switch member and being constructed and arranged to apply a biasing force to said gear engaging member;

said spring being constructed and arranged such that, when said gear engaging member is in said first ratcheting position, said spring is disposed in a first spring biasing position so that at least a component of the biasing force is directed circumferentially with respect to said gear axis;

said spring being constructed and arranged such that, when said gear engaging member is in said second ratcheting position, said spring is disposed in a second spring biasing position so that at least a component of the biasing force is directed circumferentially with respect to said gear axis;

said gear engaging member and said spring being constructed and arranged such that, when said torque receiving gear is removably coupled to a rotatable fastener in torque transmitting relation as aforesaid and said gear engaging member is in said first ratcheting position thereof, a force applied to said handle to affect a movement opposite the first torque applying movement rotates said wrench body relative to said torque receiving gear so that (a) said first abutment surface moves to a position wherein it allows said gear engaging member to move radially outward with respect to said rotational axis to permit said engaging teeth to disengage from said gear teeth, and (b) said engaging member moves generally circumferentially with respect to said gear axis with the engaging teeth thereof ratcheting over said gear teeth;

said gear engaging member and said spring being constructed and arranged such that, when said torque receiving gear is removably coupled to a rotatable fastener in torque transmitting relation as aforesaid and said gear engaging member is in said second ratcheting position thereof, a force applied to said handle to affect a movement opposite the second torque applying movement rotates said wrench body relative to said torque receiving gear so that (a) said second abutment surface moves to a position wherein it allows said gear engaging member to move radially outward with respect to said rotational axis to permit said engaging teeth to disengage from said gear teeth, and (b) said engaging member moves generally circumferentially with respect to said gear axis with the engaging teeth thereof ratcheting over said gear teeth.

11. A ratchet wrench according to claim 10, wherein said wrench body has an interior surface defining an engaging member receiving space and providing said spaced apart first and second engaging member abutment surfaces, and wherein said gear engaging member is received in said engaging member receiving space;

said ratchet wrench further comprising:

a cover member positioned in covering relation with respect to said engaging member receiving space, said cover member having a pair of spaced apart fastener receiving portions configured to receive fasteners, said fastener receiving portions and said fasteners cooperating to retain said gear engaging member within said engaging member receiving space.

12. The ratchet wrench of claim 8, further comprising a spring member operatively coupled to said switch member and said securing member to apply a biasing force to said securing member such that, when said securing member is received within the first or second securing member receiving portion, the spring member applies a biasing force to said securing member to retain the securing member in the first or second securing member receiving portion and to retain the switch member in its first or second switch position, respectively.

13. A ratchet wrench according to claim 8, wherein said spaced apart first and second securing member receiving portions and said securing member are constructed and arranged such that (a) when said switch is in said first switch position thereof, said securing member is received in said first securing member receiving portion to releasably retain said switch at said first switch position thereof until a force sufficient to urge said securing member against said spring member and out of said first securing member receiving portion is applied to said switch member and (b) when said switch is in said second switch position thereof, said securing member is received in said second securing member receiving portion to releasably retain said switch member at said second switch position thereof until a force sufficient to urge said switch against said spring member and out of the second securing member receiving portion is applied to said switch member.

* * * * *